US009487729B2

(12) United States Patent
Haque et al.

(10) Patent No.: US 9,487,729 B2
(45) Date of Patent: Nov. 8, 2016

(54) FUNCTIONALIZED POLYMERS AND OLIGOMERS AS CORROSION INHIBITORS AND ANTIWEAR ADDITIVES

(71) Applicant: ExxonMobil Chemical Patents Inc., Baytown, TX (US)

(72) Inventors: Tabassumul Haque, Bridgewater, NJ (US); Andy Haishung Tsou, Allentown, PA (US); Peter W. Jacobs, Raritan, NJ (US); Rahul Ravindra Kulkarni, Houston, TX (US); Donna Jean Crowther, Seabrook, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 117 days.

(21) Appl. No.: 14/060,149

(22) Filed: Oct. 22, 2013

(65) Prior Publication Data

US 2014/0113844 A1 Apr. 24, 2014

Related U.S. Application Data

(60) Provisional application No. 61/717,903, filed on Oct. 24, 2012.

(51) Int. Cl.

| | |
|---|---|
| ***C10M 111/04*** | (2006.01) |
| ***C07C 317/22*** | (2006.01) |
| ***C10L 1/22*** | (2006.01) |
| ***C10M 143/04*** | (2006.01) |
| ***C10M 125/02*** | (2006.01) |
| ***C10M 143/02*** | (2006.01) |
| ***C10M 133/52*** | (2006.01) |
| ***C10M 133/58*** | (2006.01) |

(52) U.S. Cl.

CPC ..... *C10M 143/04* (2013.01); *C10M 125/02* (2013.01); *C10M 133/52* (2013.01); *C10M 133/58* (2013.01); *C10M 143/02* (2013.01); *C10M 2203/1025* (2013.01); *C10M 2205/0285* (2013.01); *C10M 2215/24* (2013.01); *C10M 2215/30* (2013.01); *C10N 2230/06* (2013.01); *C10N 2230/12* (2013.01); *C10N 2230/42* (2013.01); *C10N 2230/43* (2013.01); *C10N 2230/45* (2013.01); *C10N 2230/56* (2013.01)

(58) Field of Classification Search

CPC ..... C10M 133/40; C10M 133/42; C10M 2215/221

USPC ..... 508/131, 244, 264

See application file for complete search history.

(56) References Cited

U.S. PATENT DOCUMENTS

| | | | |
|---|---|---|---|
| 1,815,022 | A | 7/1931 | Davis |
| 2,015,748 | A | 10/1935 | Frolich |
| 2,191,498 | A | 2/1940 | Reiff |
| 2,387,501 | A | 10/1945 | Dietrich |
| 2,443,264 | A | 6/1948 | Mikeska |
| 2,471,115 | A | 5/1949 | Mikeska |
| 2,526,497 | A | 10/1950 | Mikeska |
| 2,591,577 | A | 4/1952 | McDermott |
| 2,655,479 | A | 10/1953 | Munday et al. |
| 2,666,746 | A | 1/1954 | Munday et al. |
| 2,719,125 | A | 9/1955 | Roberts |
| 2,719,126 | A | 9/1955 | Fields et al. |
| 2,721,877 | A | 10/1955 | Popkin et al. |
| 2,721,878 | A | 10/1955 | Popkin |
| 3,022,305 | A | 2/1962 | Carboni |
| 3,036,003 | A | 5/1962 | Verdol |
| 3,087,932 | A | 4/1963 | Little, Jr. |
| 3,087,936 | A | 4/1963 | LeSuer |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | LeSuer |
| 3,272,746 | A | 9/1966 | LeSuer |
| 3,275,554 | A | 9/1966 | Wagenaar |
| 3,316,177 | A | 4/1967 | Dorer, Jr. |
| 3,322,670 | A | 5/1967 | Burt et el. |
| 3,329,658 | A | 7/1967 | Fields |
| 3,341,542 | A | 9/1967 | LeSuer et al. |
| 3,382,291 | A | 5/1968 | Brennan |
| 3,413,347 | A | 11/1968 | Worrel |

(Continued)

FOREIGN PATENT DOCUMENTS

| | | |
|---|---|---|
| CA | 1094044 | 1/1981 |
| EP | 0471071 B1 | 8/1995 |

(Continued)

OTHER PUBLICATIONS

Periodic Table of the Elements, Chemical and Engineering News, 1985, vol. 63, issue 5, p. 27.

L. Resconi, F. Piemontesi, G. Franciscono, L. Abis and T. Fiorani, "Olefin Polymerization at Bis (pentamethylcyclopentadienyl)zirconium and -harnium Centers: Chain-Transfer Mechanisms", J. Am .Chem. Soc., 1992, 114, pp. 1025-1032.

T. Sun, P. Brant, R.R. Chance and W.W. Graessley, "Effect of Short Chain Branching on the Coil Dimensions of Polyolefins in Dilute Solution", Macromolecules, 2001, vol, 34, pp. 6812-6820.

H. Fujita, R.P. Glovnea and H.A. Spikes, "Study of Zinc Dialkydithiophosphate Antiwear Film Formation and removal Processes, Part I: Experiments", Tribology Transactions, 2007, vol. 48, issue 4, pp. 558-566.

(Continued)

*Primary Examiner* — Prem C Singh

*Assistant Examiner* — Francis C Campanell

(74) *Attorney, Agent, or Firm* — Kevin M. Faulkner; Robert A. Migliorini

(57) ABSTRACT

Provided are lubricant compositions and hydrocarbon fluids including one or more lubricant base stocks and an effective amount of one more zero SAP antiwear additives and/or corrosion inhibitor additives, wherein the one more antiwear and/or corrosion inhibitor additives include one or more functionalized polyolefins having one or more pyridazine moieties. Such compositions exhibit improved anti-wear, friction reduction and anti-corrosion properties.

24 Claims, 13 Drawing Sheets

(56) References Cited

U.S. PATENT DOCUMENTS

| | | | |
|---|---|---|---|
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort |
| 3,454,607 | A | 7/1969 | LeSuer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al, |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,770,854 | A | 11/1973 | Morris et al. |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp at al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,501,687 | A | 2/1985 | Martel et al. |
| 4,758,362 | A | 7/1988 | Butke |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,910,355 | A | 3/1990 | Shubkin et al. |
| 4,941,984 | A | 7/1990 | Chamberlin, III et al. |
| 4,956,122 | A | 9/1990 | Watts et al. |
| 5,034,141 | A | 7/1991 | Beltzer et al. |
| 5,034,142 | A | 7/1991 | Habeeb et al. |
| 5,068,487 | A | 11/1991 | Theriot |
| 5,084,197 | A | 1/1992 | Galic et al. |
| 5,693,598 | A | 12/1997 | Abraham et al. |
| 5,705,458 | A | 1/1998 | Roby et al. |
| 5,824,627 | A | 10/1998 | McConnachie et al. |
| 5,837,657 | A | 11/1998 | Fang et al. |
| 5,906,968 | A | 5/1999 | McConnachie et al. |
| 6,010,987 | A | 1/2000 | Stiefel et al. |
| 6,034,039 | A | 3/2000 | Gomes et al. |
| 6,110,878 | A | 8/2000 | McConnachie et al. |
| 6,143,701 | A | 11/2000 | Boffa |
| 6,153,564 | A | 11/2000 | Arunasalam et al. |
| 6,232,276 | B1 | 5/2001 | Stiefel et al. |
| 6,569,820 | B2 | 5/2003 | McConnachie et al. |
| 6,689,725 | B1 | 2/2004 | Gao |
| 6,730,638 | B2 | 5/2004 | Farng et al. |
| 6,734,150 | B2 | 5/2004 | Gao et al. |
| 2007/0293405 | A1* | 12/2007 | Zhang ..... B82Y 30/00 508/113 |
| 2008/0171677 | A1 | 7/2008 | Buck et al. |
| 2010/0184982 | A1* | 7/2010 | Iwasaki ..... C10M 129/20 544/336 |

FOREIGN PATENT DOCUMENTS

| | | | |
|---|---|---|---|
| WO | 9826030 | | 6/1998 |
| WO | 9947629 | | 9/1999 |
| WO | 9966013 | A1 | 12/1999 |
| WO | 2009155471 | A2 | 12/2009 |

OTHER PUBLICATIONS

Rustmeyer, F. et al., "Photochromic Cooligomers from Pyridazinespirodihydroindolizine and Styrene", J. Mater. Chem., vol. 9, 1999, pp. 2245-2250.

Hansell, C.F. et al., "Additive-Free Clicking for Polymer Functionalization and Coupling by Tetrazine-Norbornene Chemistry", Journal of the American Chemical Society, vol. 133, No. 35, Sep. 7, 2011, pp. 13828-13831.

PCT Application No. PCT/US2013/066263, Communication from the International Searching Authority, Form PCT/ISA/210, dated Jan. 31, 2014, 5 pages.

* cited by examiner $^{1}$H NMR Vinyl Terminated Polypropylene $^{1}$H NMR Sample A $^{1}$H NMR spectrum of 3,6-Di-2-pyridyl-1,2,4,5-tetrazine in tetrachloroethane Fig. 2 The complex viscosity versus frequency plot of Vinyl Terminated Polyethylene (v-PE), Sample B and Comparative Sample C.
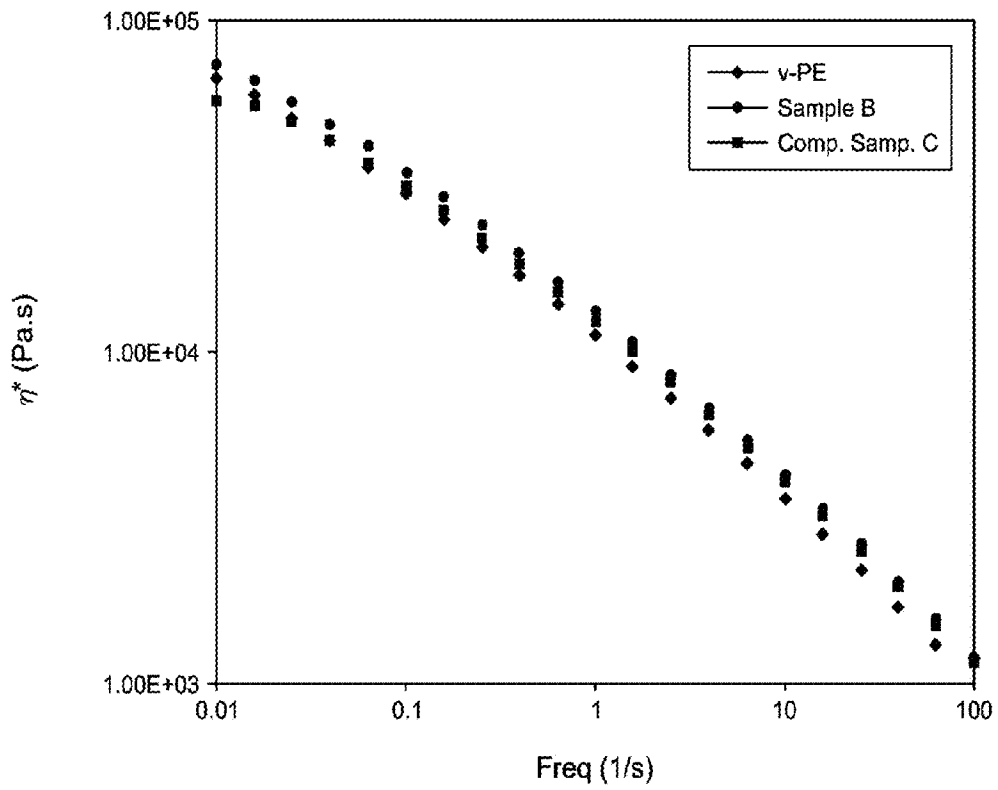

FTIR spectrum for 3,6-Di-2-pyridyl-1,2,4,5-tetrazine

Partial FTIR spectrum of Sample B compared to Comparative Sample C (a) (b) (c)

Evolution of Tribofilm - Smooth Ball/Smooth Disc

Evolution of Tribofilm on Rough Discs – Tribofilm Durability Study

FUNCTIONALIZED POLYMERS AND OLIGOMERS AS CORROSION INHIBITORS AND ANTIWEAR ADDITIVES

CROSS-REFERENCE TO RELATED APPLICATION

This application claims priority to U.S. Provisional Application Ser. No. 61/717,903 filed Oct. 24, 2012, herein incorporated by reference in its entirety.

FIELD

The present disclosure relates to the use of functionalized polymers and oligomers as corrosion inhibitors in hydrocarbon fluids and as zero SAP (sulfur, ash and phosphorus) antiwear additives in lubricants. It more particularly relates to polyolefins with the compounds having functionalized electron affinity end groups as corrosion inhibitors in hydrocarbon fluids and as antiwear additives in lubricants.

BACKGROUND

Polyolefins are non-polar products which typically have a poor affinity with traditional materials such as, for example, glass and metals in general, and are incompatible with polar synthetic polymers such as polyesters and polyamides. The ability to functionalize and therefore modify these typically chemically inert polyolefins has been highly sought after. Furthermore, the ability to efficiently and reproducibly functionalize materials such as polyethylene, polypropylene, and related copolymers with a reactive group that could be further utilized in numerous processes and end uses is particularly desirable.

Various methods to functionalize polyolefins are known. However, such methods are often characterized as tedious, time consuming, typically require air/moisture sensitive chemicals and are generally not efficient.

Examples of processes to functionalize polyolefins include the use of free radical chemistry in the reactor, such as in high pressure reactors to create ethylene-vinyl acetate type copolymers. These processes often do not provide adequate control over the number of functional groups added to the polymer.

Examples of processes to functionalize polyolefins post polymerization include grafting, wherein the polyolefin is contacted with maleic anhydride or a similar grafting material, typically in an extruder. Such processes are difficult to control and tend to cross-link or chain scission the polymer, thereby changing the properties of the functionalized polymer. Functionalization in solution is also possible, but this process is also difficult to control and requires the identification of common solvents for the polyolefins, the functional groups, and the catalysts. Additionally, solution functionalization can be ineffective with many side reactions. Functionalization in solution also requires an extra step of solvent removal.

Antiwear and Extreme Pressure Additives:

Internal combustion engine lubricating oils require the presence of antiwear and/or extreme pressure (EP) additives in order to provide adequate antiwear protection for the engine. Increasingly specifications for engine oil performance have exhibited a trend for improved antiwear properties of the oil. More specifically, fuel economy improvement strongly depends on the reduction of lubricant viscosity. This leads the engine parts run under more severe conditions causing increasing engine wear. To enable enhanced durability for the low viscosity fuel economy oils, there is a need to develop improved antiwear technologies.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

ZDDP provides excellent wear protection under mild wear conditions. However, when the viscosity of the base fluid is significantly low, i.e. when the contact severity is too high, ZDDP often fails to perform. Another negative aspect of ZDDP is that it generates volatile phosphorous when decomposed. In addition, phosphorous in the decomposed and volatile ZDDP products are responsible for poisoning the catalyst of the catalytic converter and damaging the oxygen sensors of vehicle exhaust systems. There is also increasing pressure from OEMs and government agencies to reduce P level (ZDDP) in the current engine oils. However, lowering P level may pose an enormous risk to the engine durability. Hence, there is a need for new and improved ashless antiwear additives for engine oils that do not have any harmful phosphorous and thus do not degrade the engine emission system and at the same time provides extended wear protection to engines, especially when the fuel economic low viscosity lubricants are used.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3 to 20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex ($R{=}C_8$-$C_{18}$ alkyl) are also useful antiwear agents. The use or addition of such materials should be kept to a minimum if the object is to produce low SAP formulations. Each of the aforementioned patents is incorporated by reference herein in its entirety.

Esters of glycerol may be used as antiwear agents. For example, mono-, di-, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties. Each of the aforementioned patents is incorporated herein by reference in its entirety.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP (sulfur, phosphorous and ash) formulations.

In addition, there is a growing demand for improved energy efficiency in vehicles. The use of low viscosity engine lubricants may be used in improving fuel economy in internal combustion engines by reducing viscous drag losses. However, under high load and/or low speed conditions, the thinner lubricant films result in more direct contact between surfaces causing high surface friction and wear. Hence, there is a need for new and improved antiwear additives for engine oils that can retain wear performance with low viscosity engine oils intended to improve fuel efficiency.

Corrosion Inhibitor Additives:

Corrosion inhibitors are used to reduce the degradation of metallic parts that are in contact with the lubricating oil compositions. Suitable corrosion inhibitors include thiadiazoles. See, for example, U.S. Pat. Nos. 2,719,125; 2,719,126; and 3,087,932. Such additives may be used in an amount of about 0.01 to 5 wt %, preferably about 0.01 to 1.5 wt %. There is also a need for improved corrosion inhibitor additives for lubricating oil compositions that further reduce degradation of metallic parts during use.

DEFINITIONS

In the structures depicted throughout this specification and the claims, a solid line indicates a bond, and an arrow indicates that the bond may be dative.

As used herein, the new notation for the Periodic Table Groups is used as described in *Chemical and Engineering News,* 63(5), 27 (1985).

The term "substituted" means that a hydrogen group has been replaced with a hydrocarbyl group, a heteroatom, or a heteroatom containing group. For example, methyl cyclopentadiene (Cp) is a Cp group substituted with a methyl group and ethyl alcohol is an ethyl group substituted with an —OH group.

The terms "hydrocarbyl radical," "hydrocarbyl," and "hydrocarbyl group" are used interchangeably throughout this document. Likewise, the terms "functional group," "group," and "substituent" are also used interchangeably in this document. For purposes of this disclosure, "hydrocarbyl radical" is defined to be $C_1$ to $C_{20}$ radicals, that may be linear, branched, or cyclic (aromatic or non-aromatic); and may include substituted hydrocarbyl radicals as defined herein. In an embodiment, a functional group may comprise a hydrocarbyl radical, a substituted hydrocarbyl radical, or a combination thereof.

Substituted hydrocarbyl radicals are radicals in which at least one hydrogen atom has been substituted with a heteroatom or heteroatom containing group, or with atoms from Groups 13, 14, 15, 16, and 17 of the Periodic Table of Elements, or a combination thereof, or with at least one functional group, such as halogen (Cl, Br, I, F), $NR^*_2$, $OR^*$, $SeR^*$, $TeR^*$, $PR^*_2$, $AsR^*_2$, $SbR^*_2$, $SR^*$, $BR^*_2$, $SiR^*_3$, $GeR^*_3$, $SnR^*_3$, $PbR^*_3$, and the like or where at least one heteroatom has been inserted within the hydrocarbyl radical, such as halogen (Cl, Br, I, F), O, S, Se, Te, $NR^*$, $PR^*$, $AsR^*$, $SbR^*$, $BR^*$, $SiR^*_2$, $GeR^*_2$, $SnR^*_2$, $PbR^*_2$, and the like, where R* is, independently, hydrogen or a hydrocarbyl radical, or any combination thereof.

In an embodiment, the hydrocarbyl radical is independently selected from methyl, ethyl, ethenyl, and isomers of propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, triacontyl, propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl, triacontenyl, propynyl, butynyl, pentynyl, hexynyl, heptynyl, octynyl, nonynyl, decynyl, undecynyl, dodecynyl, tridecynyl, tetradecynyl, pentadecynyl, hexadecynyl, heptadecynyl, octadecynyl, nonadecynyl, eicosynyl, heneicosynyl, docosynyl, tricosynyl, tetracosynyl, pentacosynyl, hexacosynyl, heptacosynyl, octacosynyl, nonacosynyl, and triacontynyl. Also included are isomers of saturated, partially unsaturated, and aromatic cyclic structures wherein the radical may additionally be subjected to the types of substitutions described above. Examples include phenyl, methylphenyl, benzyl, methylbenzyl, naphthyl, cyclohexyl, cyclohexenyl, methylcyclohexyl, and the like. For this disclosure, when a radical is listed, it indicates that radical type and all other radicals formed when that radical type is subjected to the substitutions defined above. Alkyl, alkenyl, and alkynyl radicals listed include all isomers including, where appropriate, cyclic isomers, for example, butyl includes n-butyl, 2-methylpropyl, 1-methylpropyl, tert-butyl, and cyclobutyl (and analogous substituted cyclopropyls); pentyl includes n-pentyl, cyclopentyl, 1-methylbutyl, 2-methylbutyl, 3-methylbutyl, 1-ethylpropyl, and neopentyl (analogous substituted cyclobutyls and cyclopropyls); and butenyl includes E and Z forms of 1-butenyl, 2-butenyl, 3-butenyl, 1-methyl-1-propenyl, 1-methyl-2-propenyl, 2-methyl-1-propenyl, and 2-methyl-2-propenyl (cyclobutenyls and cyclopropenyls). Cyclic compounds having substitutions include all isomer forms, for example, methylphenyl would include ortho-methylphenyl, meta-methylphenyl, and para-methylphenyl; dimethylphenyl would include 2,3-dimethylphenyl, 2,4-dimethylphenyl, 2,5-dimethylphenyl, 2,6-diphenylmethyl, 3,4-dimethylphenyl, and 3,5-dimethylphenyl.

An "olefin," alternatively referred to as "alkene," is a linear, branched, or cyclic compound of carbon and hydrogen having at least one double bond. For purposes of this specification and the claims appended thereto, when a polymer or copolymer is referred to as comprising an olefin, including, but not limited to, ethylene, propylene, and butene, the olefin present in such polymer or copolymer is the polymerized form of the olefin. For example, when a copolymer is said to have an "ethylene" content of 35 wt % to 55 wt %, it is understood that the mer unit in the copolymer is derived from ethylene in the polymerization reaction and said derived units are present at 35 wt % to 55 wt %, based upon the weight of the copolymer. A "polymer" has two or more of the same or different mer units. A "homopolymer" is a polymer having mer units that are the same. A "copolymer" is a polymer having two or more mer units that are different from each other. A "terpolymer" is a polymer having three mer units that are different from each other. "Different" as used to refer to mer units indicates that the mer units differ from each other by at least one atom or are different isomerically. Accordingly, the definition of copolymer, as used herein, includes terpolymers and the like. An oligomer is a polymer having a low molecular weight. In some embodiments, an oligomer has an Mn of 21,000 g/mol or less (e.g., 2,500 g/mol or less); in other embodiments, an oligomer has a low number of mer units (such as 75 mer units or less).

An "alpha-olefin" is an olefin having a double bond at the alpha (or 1-) position. A "linear alpha-olefin" or "LAO" is an olefin with a double bond at the alpha position and a linear hydrocarbon chain. A "polyalphaolefin" or "PAO" is a polymer having two or more alpha-olefin units. For the purposes of this disclosure, the term "α-olefin" includes $C_2$-$C_{20}$ olefins. Non-limiting examples of α-olefins include ethylene, propylene, 1-butene, 1-pentene, 1-hexene, 1-heptene, 1-octene, 1-nonene, 1-decene, 1-undecene 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene, 1-pentacosene, 1-hexacosene, 1-heptacosene, 1-octacosene, 1-nonacosene, 1-triacontene, 4-methyl-1-pentene, 3-methyl-1-pentene, 5-methyl-1-nonene, 3,5,5-trimethyl-1-hexene, vinylcyclohexane, and vinylnorbornane. Non-limiting examples of cyclic olefins and diolefins include cyclopropene, cyclobutene, cyclopentene, cyclohexene, cycloheptene, cyclooctene, cyclononene, cyclodecene, norbornene, 4-methylnorbornene, 2-methylcyclopentene, 4-methylcyclopentene, vinylcyclohexane, norbornadiene, dicyclopentadiene, 5-ethylidene-2-norbornene, vinylcyclohexene, 5-vinyl-2-norbornene, 1,3-divinylcyclopentane, 1,2-divinylcyclohexane, 1,3-divinylcyclohexane, 1,4-divinylcyclohexane, 1,5-divinylcyclooctane, 1-allyl-4-vinylcyclohexane, 1,4-diallylcyclohexane, 1-allyl-5-vinylcyclooctane, and 1,5-diallylcyclooctane.

For purposes herein, a polymer or polymeric chain comprises a concatenation of carbon atoms bonded to each other in a linear or a branched chain, which is referred to herein as the backbone of the polymer (e.g., polyethylene). The polymeric chain may further comprise various pendent groups attached to the polymer backbone which were present on the monomers from which the polymer was produced. These pendent groups are not to be confused with branching of the polymer backbone, the difference between pendent side chains and both short and long chain branching being readily understood by one of skill in the art.

The terms "catalyst" and "catalyst compound" are defined to mean a compound capable of initiating catalysis. In the description herein, the catalyst may be described as a catalyst precursor, a pre-catalyst compound, or a transition metal compound, and these terms are used interchangeably. A catalyst compound may be used by itself to initiate catalysis or may be used in combination with an activator to initiate catalysis. When the catalyst compound is combined with an activator to initiate catalysis, the catalyst compound is often referred to as a pre-catalyst or catalyst precursor. A "catalyst system" is a combination of at least one catalyst compound, an optional activator, an optional co-activator, and an optional support material, where the system can polymerize monomers to polymer. For the purposes of this disclosure and the claims thereto, when catalyst systems are described as comprising neutral stable forms of the components, it is well understood by one of ordinary skill in the art, that the ionic form of the component is the form that reacts with the monomers to produce polymers.

An "anionic ligand" is a negatively charged ligand which donates one or more pairs of electrons to a metal ion. A "neutral donor ligand" is a neutrally charged ligand which donates one or more pairs of electrons to a metal ion.

A "scavenger" is a compound that is typically added to facilitate polymerization by scavenging impurities. Some scavengers may also act as activators and may be referred to as co-activators. A co-activator, that is not a scavenger, may also be used in conjunction with an activator in order to form an active catalyst. In some embodiments, a co-activator can be pre-mixed with the catalyst compound to form an alkylated catalyst compound, also referred to as an alkylated disclosure compound.

A propylene polymer is a polymer having at least 50 mol % of propylene. As used herein, Mn is number average molecular weight as determined by proton nuclear magnetic resonance spectroscopy ($^1$H NMR) where the data is collected at 120° C. in a 5 mm probe using a spectrometer with a $^1$H frequency of at least 400 MHz. Data is recorded using a maximum pulse width of 45° C., 8 seconds between pulses and signal averaging 120 transients. Unless stated otherwise, Mw is weight average molecular weight as determined by gel permeation chromatography (GPC), Mz is z average molecular weight as determined by GPC as described in the Vinyl Terminated Macromonomers section below, wt % is weight percent, and mol % is mole percent. Molecular weight distribution (MWD) is defined to be Mw (GPC) divided by Mn ($^1$H NMR). Unless otherwise noted, all molecular weight units, e.g., Mw, Mn, Mz, are g/mol.

The following abbreviations may be used through this specification: Me is methyl, Ph is phenyl, Et is ethyl, Pr is propyl, iPr is isopropyl, n-Pr is normal propyl, Bu is butyl, iBu is isobutyl, tBu is tertiary butyl, p-tBu is para-tertiary butyl, nBu is normal butyl, TMS is trimethylsilyl, TIBAL is triisobutylaluminum, TNOAL is triisobutyl n-octylaluminum, MAO is methylalumoxane, pMe is para-methyl, Ar* is 2,6-diisopropylaryl, Bz is benzyl, THF is tetrahydrofuran, RT is room temperature which is defined as 25° C. unless otherwise specified, and tol is toluene.

The term "phr" is parts per hundred rubber or "parts", and is a measure common in the art wherein components of a composition are measured by weight, relative to a total weight of all of the elastomer components. The total phr or parts for all rubber components, whether one, two, three, or more different rubber components is present in a given recipe is always defined as 100 phr. All other non-rubber components are ratioed by weight against the 100 parts of rubber and are expressed in phr. This way one can easily compare, for example, the levels of curatives or filler loadings, etc., between different compositions based on the same relative proportion of rubber without the need to recalculate percents for every component after adjusting levels of only one, or more, component(s).

Hydrocarbon fluids are defined as API Group I, II, III, IV basestocks and hydrocarbonaceous fluids derived from Fischer-Tropsch process or Gas to Liquid (GTL) process.

SUMMARY

The present disclosure relates to the use of functionalized polyolefins as antiwear additives and as corrosion inhibitors in lubricating oil compositions and in other hydrocarbon fluids.

In an embodiment, a lubricant composition includes one or more base oils and an effective amount of at least one zero SAP antiwear and/or corrosion inhibitor additive comprising a functionalized polyolefin including one or more pyridazine moieties according to the following formulae:

(I)

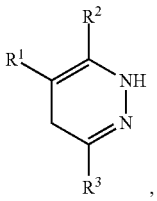

, (II)

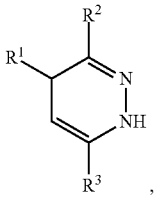

, (III)

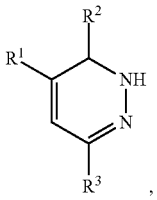

, and/or (IV)

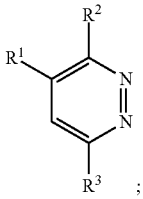

;

wherein $R^1$ comprises a polyolefin chain attached to the pyridazine moiety through an aliphatic linkage, and wherein $R_2$ and $R_3$ independently comprise H or one or more functional groups comprising atoms from Groups 13, 14, 15, 16, and 17 of the Periodic Table of Elements, or a combination thereof.

In another embodiment, a lubricant composition includes one or more base oils and an effective amount of at least one zero SAP antiwear and/or corrosion inhibitor additive comprising a polyolefin including one or more pyridazine moieties according to the following formulae:

(I)

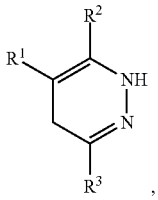

, (II)

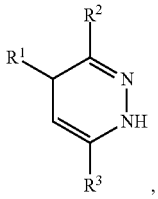

, (III)

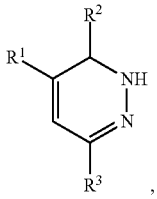

, and/or (IV)

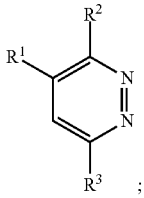

;

wherein $R_1$ comprises a polyolefin chain attached to the pyridazine moieties through an aliphatic linkage, and wherein $R_2$ and $R_3$ independently comprise H or one or more functional groups comprising atoms from Groups 13, 14, 15, 16, and 17 of the Periodic Table of Elements, or combinations thereof, wherein the pyridazine moiety is the cycloaddition reaction product of a non-aromatic carbon-carbon double bond attached to a backbone of the polyolefin chain through an aliphatic linkage, and a substituted or unsubstituted tetrazine.

BRIEF DESCRIPTION OF THE DRAWINGS

FIG. 2 is a complex viscosity versus frequency plot of vinyl terminated polyethylene, a functionalized polyolefin according to an embodiment of this invention, and a Comparative Sample.

DETAILED DESCRIPTION

Figure 1A:
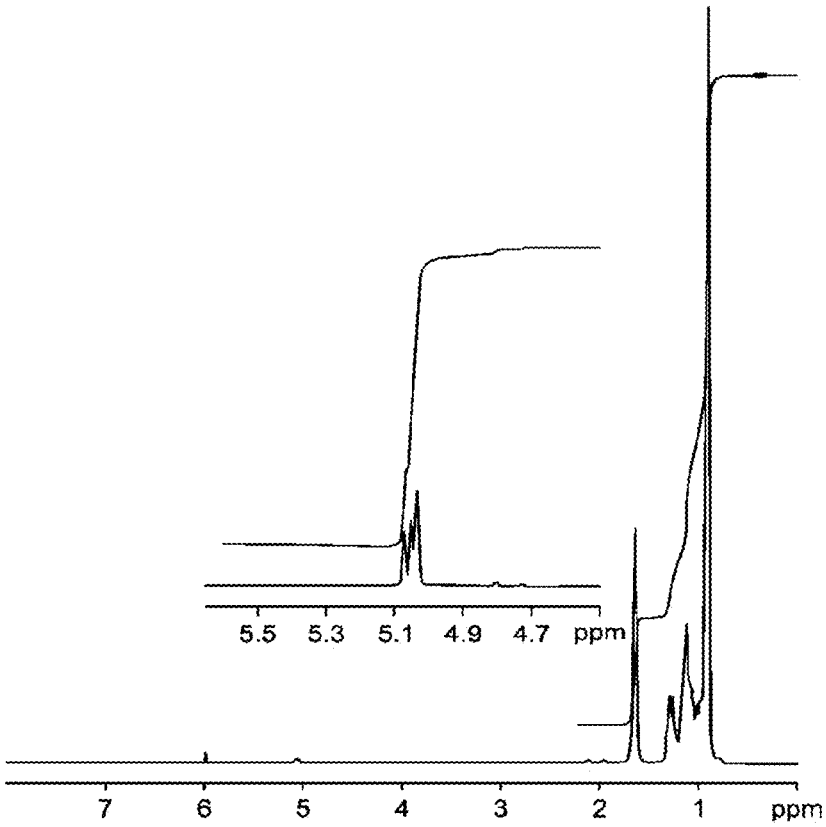
FIG. 1A is a proton nuclear magnetic resonance ($^1$H NMR) spectrum of a vinyl terminated polypropylene.

All numerical values within the detailed description and the claims herein are modified by "about" or "approximately" the indicated value, and take into account experimental error and variations that would be expected by a person having ordinary skill in the art.

The present disclosure relates to the use of amorphous polyolefins end-functionalized with electron affinity groups as zero SAP anti-wear and friction reduction additives and corrosion inhibitors in lubricant compositions and hydrocarbon fluids. The amorphous polyolefin backbone provides the additive solubility in hydrocarbon basestock whereas the chain end electron affinity group allows the additive to be adhered to the metal surfaces for wear protection, for friction reduction and for corrosion inhibition. More specifically, this disclosure directs the synthesis of vinyl terminated amorphous polyolefins for use as antiwear additive and corrosion inhibitors with number average molecular weights less than 30,000, or less than 15,000, or less than 10,000, or less than 5,000, or less than 3,000, or less than 2,000, or less than 1,000, or less than 500. The number average molecular weight may range from 200 to 10,000, or 500 to 5,000, or 1,000 to 2,000. The polyolefins need to be amorphous devoid of any crystallinity and can be copolymers of linear alpha olefins or homopolymers without any stereo-regularity, such as the atactic polyolefins. These vinyl chain ends can then be functionalized with functional groups that have strong electron affinity, such as aromatic rings (e.g., benzene) or heterocyclic rings containing nitrogen (e.g. pyridines, diazines, triazines and hexazines) or sulfur containing compounds (e.g. thiophene, benzothiadiazole). Most specifically, this disclosure directs the functionalization of vinyl terminated polyolefins in solid state by reacting with dipyridyl tetrazine without any catalysts based on the Diels-Alder reaction. The usage of polyolefins containing dipyridyl tetrazine end group in conventional or synthetic basestocks at 5 wt % or less, more preferably at 3 wt % or less, most preferably at 1.5 wt % or less, can provide wear protection of the metal surfaces, friction reduction and also corrosion protection.

In one form of the present disclosure, a lubricant composition includes one or more base oils and an effective amount of at least one zero SAP antiwear and/or corrosion inhibitor additive comprising a functionalized polyolefin including one or more pyridazine moieties according to the following formulae:

(I)

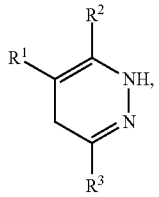

(II)

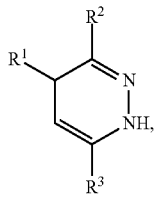

(III)

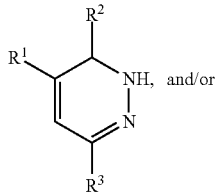

(IV)

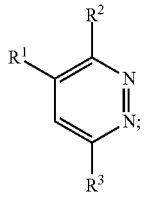

wherein $R^1$ comprises a polyolefin chain attached to the pyridazine moiety through an aliphatic linkage, and wherein $R^2$ and $R^3$ independently comprise H or one or more functional groups comprising atoms from Groups 13, 14, 15, 16, and 17 of the Periodic Table of Elements, or a combination thereof.

In another embodiment, a lubricant composition includes one or more base oils and an effective amount of at least one zero SAP antiwear and/or corrosion inhibitor additive comprising a polyolefin including one or more pyridazine moieties according to the following formulae:

(I)

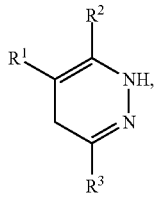

-continued (II)

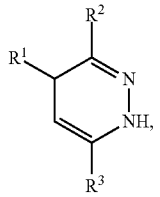

(III)

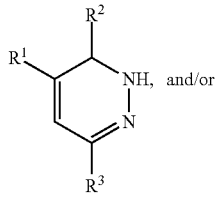

(IV)

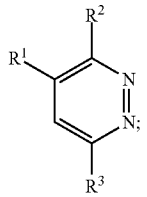

wherein $R^1$ comprises a polyolefin chain attached to the pyridazine moieties through an aliphatic linkage, and wherein $R^2$ and $R^3$ independently comprise H or one or more functional groups comprising atoms from Groups 13, 14, 15, 16, and 17 of the Periodic Table of Elements, or combinations thereof, wherein the pyridazine moiety is the cycloaddition reaction product of a non-aromatic carbon-carbon double bond attached to a backbone of the polyolefin chain through an aliphatic linkage, and a substituted or unsubstituted tetrazine.

An effective amount of at least one antiwear additive in a lubricating oil composition may range from 1000 ppm to 5 wt % of the total composition, or 2000 ppm to 3 wt %, or 5000 ppm to 1.5 wt %, or 7500 ppm to 1.0 wt %. An effective amount of at least one corrosion inhibitor additive in a lubricating oil composition or hydrocarbon fluid may range from 10 ppm to 3 wt % of the total composition or fluid, or 50 ppm to 2.0 wt %, or 100 ppm to 1.0 wt %, or 200 ppm to 800 ppm.

Lubricating Oil Base Stocks

A wide range of lubricating base oils are known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad lube base oil stock categories developed and defined by the American Petroleum Institute (API Publication 1509; www.API.org) to create guidelines for lubricant base oils. Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_8$ to $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company).

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/ followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i e amounts only associated with their use as diluents/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from 50 to 99 weight percent, preferably from 70 to 95 weight percent, and more preferably from 85 to 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of 2.5 cSt to 12 cSt (or $mm^2/s$) at 100° C. and preferably of 2.5 cSt to 9 cSt (or $mm^2/s$) at 100° C. Mixtures of synthetic and natural base oils may be used if desired.

Functionalized Polymers and Oligomers as Antiwear Additives and Corrosion Inhibitors The inventors have surprisingly found new methods of modifying polyolefins having one or more carbon-carbon double bond to produce new polyolefins having a pyridazine moiety that function effectively as antiwear additives in lubricant composition and corrosion inhibitors in hydrocarbon fluids. Preferably, the carbon-carbon double bond of the polyolefin is a vinyl group, but it is within the scope of this invention that polyolefins having other double bonds (such as vinylidenes or internal double bonds) may be useful in embodiments herein.

Advantageously, these inventive methods are industrially benign, utilizing materials that are not explosive or air or moisture sensitive. The methods are also industrially cost-effective, as they require no catalyst. Even more advantageously, these reactions are environmentally benign as they produce nitrogen, which is volatile, inert, and non-toxic, as the only byproduct.

In an embodiment, the polyolefins of the present invention are produced via "click" chemistry, wherein selected reactions are classified as click chemistry for being specific, wide in scope, result in high yields, and which generate only safe byproducts, which may be processed under simple conditions, with readily available starting materials and without any solvent, consistent with the term "click chemistry" as is commonly known in the art. In some embodiments, the present disclosure is directed to a polyolefin useful as an antiwear additive and as a corrosion inhibitor comprising one or more pyridazine moieties according to the following formulae:

(I)

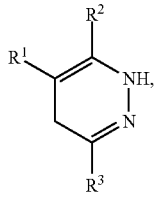

(II)

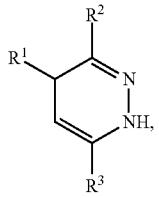

-continued (III)

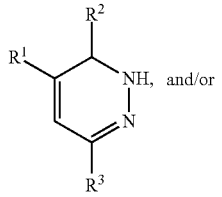

(IV)

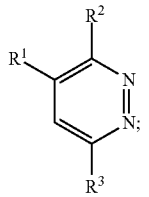

wherein $R^1$ comprises a polyolefin chain attached to the pyridazine moiety through an aliphatic linkage, and wherein $R^2$ and $R^3$ each comprise hydrogen (H) or one or more functional groups comprising atoms from Groups 13, 14, 15, 16, and 17 of the Periodic Table of Elements, or a combination thereof. As used herein "an aliphatic linkage" includes a direct linkage to the aliphatic polyolefin. In an embodiment, the aliphatic linkage is comprised of non-aromatic carbon-carbon bonds connecting the pyridazine ring to the backbone of the polymeric chain.

In an embodiment, the pyridazine moiety is directly bonded to the backbone of the polymer chain. In an embodiment, the pyridazine moiety is bonded to the backbone of the polymer chain through a chain comprising one or more carbon-carbon single bonds, double bonds, carbon-oxygen bonds, e.g., ether bonds, carbon-nitrogen bonds, e.g., amine bonds; carbon-sulfur bonds, e.g., thio-ether bonds; carbon-phosphorous bonds, or a combination thereof. In an embodiment, the pyridazine moiety is a terminal moiety of the polyolefin chain. In an embodiment, the pyridazine moiety may be attached to the polymer backbone through a pendant group attached to the polymer backbone.

In an embodiment, the pyridazine moiety is attached to the polymer backbone subject to the proviso that the pyridazine moiety is not attached to the polymer backbone through a chain comprising an aromatic bond in the linkage connecting the pyridazine ring to the polymer backbone. Accordingly, a polymer comprising divinyl benzene or other divinyl aromatic monomers, wherein the pyridazine moiety is attached to the polymer backbone pendent to an aromatic ring is specifically not included as an embodiment for purposes herein. In embodiments herein, in polymers comprising divinyl benzene or other divinyl aromatic monomers, pyridazine moieties attached to the polymer backbone pendent to aromatic rings are absent.

In an embodiment, the polyolefin chain of the antiwear and corrosion inhibitor additives comprises a $C_2$-$C_{20}$ poly-alpha-olefin having a Mw of greater than or equal to about 2500 g/mol (preferably greater than or equal to about 3000 g/mol, greater than or equal to 3500 g/mol, and greater than or equal to 4000 g/mol).

In an embodiment, the polyolefin chain comprises ethylene, propylene, 1-butene, 1pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene, 1-pentacosene, 1-hexacosene, 1-heptacosene, 1-octacosene, 1-nonacosene, 1-triacontene, 4-methyl-1-pentene, 3-methyl-1-pentene, 5-methyl-1-nonene, 3,5,5-trimethyl-1-hexene, vinylcyclohexane, vinylnorbornane, cyclobutene, cyclopentene, cyclohexene, cycloheptene, cyclooctene, cyclononene, cyclodecene, norbornene, 4-methylnorbornene, 2-methylcyclopentene, 4-methylcyclopentene, vinylcyclohexane, norbornadiene, dicyclopentadiene, 5-ethylidene-2-norbornene, vinylcyclohexene, 5-vinyl-2-norbornene, 1,3-divinylcyclopentane, 1,2-divinylcyclohexane, 1,3-divinyl cyclohexane, 1,4-divinylcyclohexane, 1,5-divinylcyclooctane, 1-allyl-4-vinylcyclohexane, 1,4-diallylcyclohexane, 1-allyl-5-vinylcyclooctane, 1,5-diallylcyclooctane, or a combination thereof.

In an embodiment, the polyolefin chain of the antiwear and corrosion inhibitor additives comprises ethylene, propylene, butene, hexene, octene, or a combination thereof.

In an embodiment of the present invention, the polyolefin chain ($R^1$) in Formula (I) is derived from polyethylene, polypropylene, polybutadiene, butyl rubber, or vinyl terminated macromonomers. In an embodiment, the polyolefin chain ($R^1$) is derived from an ethylene-diene copolymer, which may include ethylene-norbornene copolymers, and the like.

A "vinyl terminated macromonomer," as used herein, refers to one or more of:

(i) a vinyl terminated polymer having at least 5% allyl chain ends (preferably 15%, 20%, 30%, 40%, 50%, 60%, 70%, 80%, 90%, 95%, 98%, or 99%);

(ii) a vinyl terminated polymer having an Mn of at least 200 g/mol (measured by $^1$H NMR) comprising of one or more $C_4$ to $C_{40}$ higher olefin derived units, where the higher olefin polymer comprises substantially no propylene derived units; and wherein the higher olefin polymer has at least 5% allyl chain ends;

(iii) a copolymer having an Mn of 300 g/mol or more (measured by $^1$H NMR) comprising (a) from about 20 mol % to about 99.9 mol % of at least one $C_5$ to $C_{40}$ higher olefin, and (b) from about 0.1 mol % to about 80 mol % of propylene, wherein the higher olefin copolymer has at least 40% allyl chain ends;

(iv) a copolymer having an Mn of 300 g/mol or more (measured by 1H NMR), and comprises (a) from about 80 mol % to about 99.9 mol % of at least one C4 olefin, (b) from about 0.1 mol % to about 20 mol % of propylene; and wherein the vinyl terminated macromonomer has at least 40% allyl chain ends relative to total unsaturation;

(v) a co-oligomer having an Mn of 300 g/mol to 30,000 g/mol (measured by 1H NMR) comprising 10 mol % to 90 mol % propylene and 10 mol % to 90 mol % of ethylene, wherein the oligomer has at least X % allyl chain ends (relative to total unsaturations), where: 1) X=(−0.94*(mol % ethylene incorporated)+100), when 10 mol % to 60 mol % ethylene is present in the co-oligomer, 2) X=45, when greater than 60 mol % and less than 70 mol % ethylene is present in the co-oligomer, and 3) X=(1.83*(mol % ethylene incorporated)−83), when 70 mol % to 90 mol % ethylene is present in the co-oligomer;

(vi) a propylene oligomer, comprising more than 90 mol % propylene and less than 10 mol % ethylene wherein the oligomer has: at least 93% allyl chain ends, a number average molecular weight (Mn) of about 500 g/mol to about 20,000 g/mol, an isobutyl chain end to allylic vinyl group ratio of 0.8:1 to 1.35:1.0, and less than 100 ppm aluminum;

(vii) a propylene oligomer, comprising: at least 50 mol % propylene and from 10 mol % to 50 mol % ethylene, wherein the oligomer has: at least 90% allyl chain ends, an Mn of about 150 g/mol to about 10,000 g/mol, and an isobutyl chain end to allylic vinyl group ratio of 0.8:1 to 1.2:1.0, wherein monomers having four or more carbon atoms are present at from 0 mol % to 3 mol %;

(viii) a propylene oligomer, comprising: at least 50 mol % propylene, from 0.1 mol % to 45 mol % ethylene, and from 0.1 mol % to 5 mol % $C_4$ to $C_{12}$ olefin, wherein the oligomer has: at least 90% allyl chain ends, an Mn of about 150 g/mol to about 10,000 g/mol, and an isobutyl chain end to allylic vinyl group ratio of 0.8:1 to 1.35:1.0;

(ix) a propylene oligomer, comprising: at least 50 mol % propylene, from 0.1 mol % to 45 mol % ethylene, and from 0.1 mol % to 5 mol % diene, wherein the oligomer has: at least 90% allyl chain ends, an Mn of about 150 g/mol to about 10,000 g/mol, and an isobutyl chain end to allylic vinyl group ratio of 0.7:1 to 1.35:1.0; and (x) a homo-oligomer, comprising propylene, wherein the oligomer has: at least 93% allyl chain ends, an Mn of about 500 g/mol to about 20,000 g/mol, an isobutyl chain end to allylic vinyl group ratio of 0.8:1 to 1.2:1.0, and less than 1400 ppm aluminum.

In some embodiments, the vinyl terminated macromonomer has an Mn of at least 200 g/mol, (e.g., 200 g/mol to 100,000 g/mol, e.g., 200 g/mol to 75,000 g/mol, e.g., 200 g/mol to 60,000 g/mol, e.g., 300 g/mol to 60,000 g/mol, or e.g., 750 g/mol to 30,000 g/mol) (measured by $^1$H NMR) and comprise one or more (e.g., two or more, three or more, four or more, and the like) $C_4$ to $C_{40}$ (e.g., $C_4$ to $C_{30}$, $C_4$ to $C_{20}$, or $C_4$ to $C_{12}$, e.g., butene, pentene, hexene, heptene, octene, nonene, decene, undecene, dodecene, norbornene, norbornadiene, dicyclopentadiene, cyclopentene, cycloheptene, cyclooctene, cyclooctadiene, cyclododecene, 7-oxanorbornene, 7-oxanorbornadiene, substituted derivatives thereof, and isomers thereof) olefin derived units, where the vinyl terminated macromonomer comprises substantially no propylene derived units (e.g., less than 0.1 wt % propylene, e.g., 0 wt %); and wherein the vinyl terminated macromonomer has at least 5% (at least 10%, at least 15%, at least 20%, at least 30%, at least 40%, at least 50%, at least 60%, at least 70%; at least 80%, at least 90%, or at least 95%) allyl chain ends (relative to total unsaturation); and optionally, an allyl chain end to vinylidene chain end ratio of 1:1 or greater (e.g., greater than 2:1, greater than 2.5:1, greater than 3:1, greater than 5:1, or greater than 10:1); and even further optionally, e.g., substantially no isobutyl chain ends (e.g., less than 0.1 wt % isobutyl chain ends). In some embodiments, the vinyl terminated macromonomers may also comprise ethylene derived units, e.g., at least 5 mol % ethylene (e.g., at least 15 mol % ethylene, e.g., at least 25 mol % ethylene, e.g., at least 35 mol % ethylene, e.g., at least 45 mol % ethylene, e.g., at least 60 mol % ethylene, e.g., at least 75 mol % ethylene, or e.g., at least 90 mol % ethylene). Such vinyl terminated macromonomers are further described in U.S. Ser. No. 13/072,288, which is hereby incorporated by reference.

In some embodiments, the vinyl terminated macromonomers may have an Mn (measured by $^1$H NMR) of greater than 200 g/mol (e.g., 300 g/mol to 60,000 g/mol, 400 g/mol to 50,000 g/mol, 500 g/mol to 35,000 g/mol, 300 g/mol to 15,000 g/mol, 400 g/mol to 12,000 g/mol, or 750 g/mol to 10,000 g/mol), and comprise:

(a) from about 20 mol % to 99.9 mol % (e.g., from about 25 mol % to about 90 mol %, from about 30 mol % to about 85 mol %, from about 35 mol % to about 80 mol %, from about 40 mol % to about 75 mol %, or from about 50 mol % to about 95 mol %) of at least one $C_5$ to $C_{40}$ (e.g., $C_6$ to $C_{20}$) higher olefin; and (b) from about 0.1 mol % to 80 mol % (e.g., from about 5 mol % to 70 mol %, from about 10 mol % to about 65 mol %, from about 15 mol % to about 55 mol %, from about 25 mol % to about 50 mol %, or from about 30 mol % to about 80 mol %) of propylene;

wherein the vinyl terminated macromonomer has at least 40% allyl chain ends (e.g., at least 50% allyl chain ends, at least 60% allyl chain ends, at least 70% allyl chain ends, or at least 80% allyl chain ends, at least 90% allyl chain ends, at least 95% allyl chain ends) relative to total unsaturation; and, optionally, an isobutyl chain end to allyl chain end ratio of less than 0.70:1, less than 0.65:1, less than 0.60:1, less than 0.50:1, or less than 0.25:1; and further optionally, an allyl chain end to vinylidene chain end ratio of greater than 2:1 (e.g., greater than 2.5:1, greater than 3:1, greater than 5:1, or greater than 10:1); and even further optionally, an allyl chain end to vinylene ratio is greater than 1:1 (e.g., greater than 2:1 or greater than 5:1). Such macromonomers are further described in U.S. Ser. No. 13/072,249, hereby incorporated by reference.

In another embodiment, the vinyl terminated macromonomer has an Mn of 300 g/mol or more (measured by $^1$H NMR, e.g., 300 g/mol to 60,000 g/mol, 400 g/mol to 50,000 g/mol, 500 g/mol to 35,000 g/mol, 300 g/mol to 15,000 g/mol, 400 g/mol to 12,000 g/mol, or 750 g/mol to 10,000 g/mol), and comprises:

(a) from about 80 mol % to about 99.9 mol % of at least one $C_4$ olefin, e.g., about 85 mol % to about 99.9 mol %, e.g., about 90 mol % to about 99.9 mol %;

(b) from about 0.1 mol % to about 20 mol % of propylene, e.g., about 0.1 mol % to about 15 mol %, e.g., about 0.1 mol % to about 10 mol %; and wherein the vinyl terminated macromonomer has at least 40% allyl chain ends (e.g., at least 50% allyl chain ends, at least 60% allyl chain ends, at least 70% allyl chain ends, or at least 80% allyl chain ends, at least 90% allyl chain ends, at least 95% allyl chain ends) relative to total unsaturation, and in some embodiments, an isobutyl chain end to allyl chain end ratio of less than 0.70:1, less than 0.65:1, less than 0.60:1, less than 0.50:1, or less than 0.25:1, and in further embodiments, an allyl chain end to vinylidene group ratio of more than 2:1, more than 2.5:1, more than 3:1, more than 5:1, or more than 10:1. Such macromonomers are also further described in U.S. Ser. No. 13/072,249, which is hereby incorporated by reference.

In other embodiments, the vinyl terminated macromonomer is a propylene co-oligomer having an Mn of 300 g/mol to 30,000 g/mol as measured by $^1$H NMR (e.g., 400 g/mol to 20,000 g/mol, e.g., 500 g/mol to 15,000 g/mol, e.g., 600 g/mol to 12,000 g/mol, e.g., 800 g/mol to 10,000 g/mol, e.g., 900 g/mol to 8,000 g/mol, e.g., 900 g/mol to 7,000 g/mol), comprising 10 mol % to 90 mol % propylene (e.g., 15 mol % to 85 mol %, e.g., 20 mol % to 80 mol %, e.g., 30 mol % to 75 mol %, e.g., 50 mol % to 90 mol %) and 10 mol % to 90 mol % (e.g., 85 mol % to 15 mol %, e.g., 20 mol % to 80 mol %, e.g., 25 mol % to 70 mol %, e.g., 10 mol % to 50 mol %) of one or more alpha-olefin comonomers (e.g., ethylene, butene, hexene, or octene, e.g., ethylene), wherein the oligomer has at least X % allyl chain ends (relative to total unsaturations), where: 1) X=(−0.94 (mol % ethylene incorporated)+100 {alternately 1.20 (−0.94 (mol % ethylene incorporated)+100), alternately 1.50 (−0.94 (mol % ethylene incorporated)+100)}), when 10 mol % to 60 mol % ethylene is present in the co-oligomer; 2) X=45 (alternately 50, alternately 60), when greater than 60 mol % and less than 70 mol % ethylene is present in the co-oligomer; and 3) X=(1.83*(mol % ethylene incorporated)−83, {alternately 1.20 [1.83*(mol % ethylene incorporated)−83], alternately 1.50 [1.83*(mol % ethylene incorporated)−83]}), when 70 mol % to 90 mol % ethylene is present in the co-oligomer. Such macromonomers are further described in U.S. Ser. No. 12/143,663, which is hereby incorporated by reference.

In other embodiments, the vinyl terminated macromonomer is a propylene oligomer, comprising more than 90 mol % propylene (e.g., 95 mol % to 99 mol %, e.g., 98 mol % to 9 mol %) and less than 10 mol % ethylene (e.g., 1 mol % to 4 mol %, e.g., 1 mol % to 2 mol %), wherein the oligomer has: at least 93% allyl chain ends (e.g., at least 95%, e.g., at least 97%, e.g., at least 98%); a number average molecular weight (Mn) of about 400 g/mol to about 30,000 g/mol, as measured by $^1$H NMR (e.g., 500 g/mol to 20,000 g/mol, e.g., 600 g/mol to 15,000 g/mol, e.g., 700 g/mol to 10,000 g/mol, e.g., 800 g/mol to 9,000 g/mol, e.g., 900 g/mol to 8,000 g/mol, e.g., 1,000 g/mol to 6,000 g/mol); an isobutyl chain end to allylic vinyl group ratio of 0.8:1 to 1.35:1.0, and less than 1400 ppm aluminum, (e.g., less than 1200 ppm, e.g., less than 1000 ppm, e.g., less than 500 ppm, e.g., less than 100 ppm). Such macromonomers are further described in U.S. Ser. No. 12/143,663.

In other embodiments, the vinyl terminated macromonomer is a propylene oligomer, comprising: at least 50 mol % (e.g., 60 mol % to 90 mol %, e.g., 70 mol % to 90 mol %) propylene and from 10 mol % to 50 mol % (e.g., 10 mol % to 40 mol %, e.g., 10 mol % to 30 mol %) ethylene, wherein the oligomer has: at least 90% allyl chain ends (e.g., at least 91%, e.g., at least 93%, e.g., at least 95%, e.g., at least 98%); an Mn of about 150 g/mol to about 20,000 g/mol, as measured by $^1$H NMR (e.g., 200 g/mol to 15,000 g/mol, e.g., 250 g/mol to 15,000 g/mol, e.g., 300 g/mol to 10,000 g/mol, e.g., 400 g/mol to 9,500 g/mol, e.g., 500 g/mol to 9,000 g/mol, e.g., 750 g/mol to 9,000 g/mol); and an isobutyl chain end to allylic vinyl group ratio of 0.8:1 to 1.3:1.0, wherein monomers having four or more carbon atoms are present at from 0 mol % to 3 mol % (e.g., at less than 1 mol %, e.g., less than 0.5 mol %, e.g., at 0 mol %). Such macromonomers are further described in U.S. Ser. No. 12/143,663.

In other embodiments, the vinyl terminated macromonomer is a propylene oligomer, comprising: at least 50 mol % (e.g., at least 60 mol %, e.g., 70 mol % to 99.5 mol %, e.g., 80 mol % to 99 mol %, e.g., 90 mol % to 98.5 mol %) propylene, from 0.1 mol % to 45 mol % (e.g., at least 35 mol %, e.g., 0.5 mol % to 30 mol %, e.g., 1 mol % to 20 mol %, e.g., 1.5 mol % to 10 mol %) ethylene, and from 0.1 mol % to 5 mol % (e.g., 0.5 mol % to 3 mol %, e.g., 0.5 mol % to 1 mol %) $C_4$ to $C_{12}$ olefin (such as butene, hexene, or octene, e.g., butene), wherein the oligomer has: at least 90% allyl chain ends (e.g., at least 91%, e.g., at least 93%, e.g., at least 95%, e.g., at least 98%); a number average molecular weight (Mn) of about 150 g/mol to about 15,000 g/mol, as measured by $^1$H NMR (e.g., 200 g/mol to 12,000 g/mol, e.g., 250 g/mol to 10,000 g/mol, e.g., 300 g/mol to 10,000 g/mol, e.g., 400 g/mol to 9500 g/mol, e.g., 500 g/mol to 9,000 g/mol, e.g., 750 g/mol to 9,000 g/mol); and an isobutyl chain end to allylic vinyl group ratio of 0.8:1 to 1.35:1.0. Such macromonomers are further described in U.S. Ser. No. 12/143,663.

In other embodiments, the vinyl terminated macromonomer is a propylene oligomer, comprising: at least 50 mol % (e.g., at least 60 mol %, e.g., 70 mol % to 99.5 mol %, e.g., 80 mol % to 99 mol %, e.g., 90 mol % to 98.5 mol %) propylene, from 0.1 mol % to 45 mol % (e.g., at least 35 mol %, e.g., 0.5 mol % to 30 mol %, e.g., 1 mol % to 20 mol %, e.g., 1.5 mol % to 10 mol %) ethylene, and from 0.1 mol % to 5 mol % (e.g., 0.5 mol % to 3 mol %, e.g., 0.5 mol % to 1 mol %) diene (such as $C_4$ to $C_{12}$ alpha-omega dienes (such as butadiene, hexadiene, octadiene), norbornene, ethylidene norbornene, vinylnorbornene, norbornadiene, and dicyclopentadiene), wherein the oligomer has at least 90% allyl chain ends (e.g., at least 91%, e.g., at least 93%, e.g., at least 95%, e.g., at least 98%); a number average molecular weight (Mn) of about 150 g/mol to about 20,000 g/mol, as measured by $^1$H NMR (e.g., 200 g/mol to 15,000 g/mol, e.g., 250 g/mol to 12,000 g/mol, e.g., 300 g/mol to 10,000 g/mol, e.g., 400 g/mol to 9,500 g/mol, e.g., 500 g/mol to 9,000 g/mol, e.g., 750 g/mol to 9,000 g/mol); and an isobutyl chain end to allylic vinyl group ratio of 0.7:1 to 1.35:1.0. Such macromonomers are further described in U.S. Ser. No. 12/143,663.

In other embodiments, the vinyl terminated macromonomer is a propylene homo-oligomer, comprising propylene and less than 0.5 wt % comonomer, e.g., 0 wt % comonomer, wherein the oligomer has:

i) at least 93% allyl chain ends (e.g., at least 95%, e.g., at least 96%, e.g., at least 97%, e.g., at least 98%, e.g., at least 99%);
ii) a number average molecular weight (Mn) of about 500 g/mol to about 20,000 g/mol, as measured by $^1$H NMR (e.g., 500 g/mol to 15,000 g/mol, e.g., 700 g/mol to 10,000 g/mol, e.g., 800 g/mol to 8,000 g/mol, e.g., 900 g/mol to 7,000 g/mol, e.g., 1,000 g/mol to 6,000 g/mol, e.g., 1,000 g/mol to 5,000 g/mol);
iii) an isobutyl chain end to allylic vinyl group ratio of 0.8:1 to 1.3:1.0; and
iv) less than 1400 ppm aluminum, (e.g., less than 1200 ppm, e.g., less than 1000 ppm, e.g., less than 500 ppm, e.g., less than 100 ppm). Such macromonomers are also further described in U.S. Ser. No. 12/143,663.

The vinyl terminated macromonomers may be homopolymers, copolymers, terpolymers, and so on. Any vinyl terminated macromonomers described herein has one or more of:

(i) an isobutyl chain end to allylic vinyl group ratio of 0.8:1 to 1.3:1.0;
(ii) an allyl chain end to vinylidene chain end ratio of greater than 2:1 (e.g., greater than 2.5:1, greater than 3:1, greater than 5:1, or greater than 10:1);
(iii) an allyl chain end to vinylene ratio is greater than 1:1 (e.g., greater than 2:1 or greater than 5:1); and
(iv) at least 5% allyl chain ends (preferably 15%, 20%, 30%, 40%, 50%, 60%, 70%, 80%, 90%, 95%, 98%, or 99%).

Vinyl terminated macromonomers generally have a saturated chain end (or terminus) and/or an unsaturated chain end or terminus. The unsaturated chain end of the vinyl terminated macromonomer comprises an "allyl chain end" or a "3-alkyl" chain end. An allyl chain end is represented by $CH_2CH—CH_2—$, as shown in the formula:

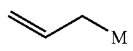

where M represents the polymer chain. "Allylic vinyl group," "allyl chain end," "vinyl chain end," "vinyl termination," "allylic vinyl group," and "vinyl terminated" are used interchangeably in the following description. The number of allyl chain ends, vinylidene chain ends, vinylene chain ends, and other unsaturated chain ends is determined using $^1$H NMR at 120° C. using deuterated tetrachloroethane as the solvent on an at least 250 MHz NMR spectrometer, and in selected cases, confirmed by $^{13}$C NMR. Resconi has reported proton and carbon assignments (neat perdeuterated tetrachloroethane used for proton spectra, while a 50:50 mixture of normal and perdeuterated tetrachloroethane was used for carbon spectra; all spectra were recorded at 100° C. on a BRUKER spectrometer operating at 500 MHz for proton and 125 MHz for carbon) for vinyl terminated oligomers in *J. American Chemical Soc.,* 114, 1992, pp. 1025-1032 that are useful herein. Allyl chain ends are reported as a molar percentage of the total number of moles of unsaturated groups (that is, the sum of allyl chain ends, vinylidene chain ends, vinylene chain ends, and the like).

A 3-alkyl chain end (where the alkyl is a $C_1$ to $C_{38}$ alkyl), also referred to as a "3-alkyl vinyl end group" or a "3-alkyl vinyl termination", is represented by the formula:

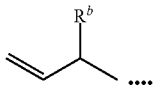

3-alkyl vinyl end group where "••••" represents the polyolefin chain and $R^b$ is a $C_1$ to $C_{38}$ alkyl group, or a $C_1$ to $C_{20}$ alkyl group, such as methyl, ethyl, propyl, butyl, pentyl, hexyl, heptyl, octyl, nonyl, decyl, undecyl, dodecyl, and the like. The amount of 3-alkyl chain ends is determined using $^{13}C$ NMR as set out below.

$^{13}C$ NMR data is collected at 120° C. at a frequency of at least 100 MHz, using a BRUKER 400 MHz NMR spectrometer. A 90 degree pulse, an acquisition time adjusted to give a digital resolution between 0.1 and 0.12 Hz, at least a 10 second pulse acquisition delay time with continuous broadband proton decoupling using swept square wave modulation without gating is employed during the entire acquisition period. The spectra is acquired with time averaging to provide a signal to noise level adequate to measure the signals of interest. Samples are dissolved in tetrachloroethane-$d_2$ at concentrations between 10 wt % to 15 wt % prior to being inserted into the spectrometer magnet. Prior to data analysis spectra are referenced by setting the chemical shift of the TCE solvent signal to 74.39 ppm. Chain ends for quantization were identified using the signals shown in the table below. N-butyl and n-propyl were not reported due to their low abundance (less than 5%) relative to the chain ends shown in the table below.

| Chain End | $^{13}C$ NMR Chemical Shift |
|---|---|
| P~i-Bu | 23-5 to 25.5 and 25.8 to 26.3 ppm |
| E~i-Bu | 39.5 to 40.2 ppm |
| P~Vinyl | 41.5 to 43 ppm |
| E~Vinyl | 33.9 to 34.4 ppm |

The "allyl chain end to vinylidene chain end ratio" is defined to be the ratio of the percentage of allyl chain ends to the percentage of vinylidene chain ends. The "allyl chain end to vinylene chain end ratio" is defined to be the ratio of the percentage of allyl chain ends to the percentage of vinylene chain ends. Vinyl terminated macromonomers typically also have a saturated chain end. In polymerizations where propylene is present, the polymer chain may initiate growth in a propylene monomer, thereby generating an isobutyl chain end. An "isobutyl chain end" is defined to be an end or terminus of a polymer, represented as shown in the formula below:

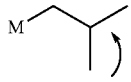

isobutyl chain end where M represents the polymer chain. Isobutyl chain ends are determined according to the procedure set out in WO 2009/155471. The "isobutyl chain end to allylic vinyl group ratio" is defined to be the ratio of the percentage of isobutyl chain ends to the percentage of allyl chain ends.

In polymerizations comprising $C_4$ or greater monomers (or "higher olefin" monomers), the saturated chain end may be a $C_4$ or greater (or "higher olefin") chain end, as shown in the formula below:

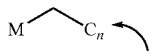

higher olefin chain end where M represents the polymer chain and n is an integer selected from 4 to 40. This is especially true when there is substantially no ethylene or propylene in the polymerization. In an ethylene/($C_4$ or greater monomer) copolymerization, the polymer chain may initiate growth in an ethylene monomer, thereby generating a saturated chain end which is an ethyl chain end. Mn ($^1H$ NMR) is determined according to the following NMR method. $^1H$ NMR data is collected at either room temperature or 120° C. (for purposes of the claims, 120° C. shall be used) in a 5 mm probe using a Varian spectrometer with a $^1H$ frequency of 250 MHz, 400 MHz, or 500 MHz (for the purpose of the claims, a proton frequency of 400 MHz is used). Data are recorded using a maximum pulse width of 45° C., 8 seconds between pulses and signal averaging 120 transients. Spectral signals are integrated and the number of unsaturation types per 1000 carbons is calculated by multiplying the different groups by 1000 and dividing the result by the total number of carbons. Mn is calculated by dividing the total number of unsaturated species into 14,000, and has units of g/mol. The chemical shift regions for the olefin types are defined to be between the following spectral regions.

| Unsaturation Type | Region (ppm) | Number of hydrogens per structure |
|---|---|---|
| Vinyl | 4.95-5.10 | 2 |
| Vinylidene (VYD) | 4.70-4.84 | 2 |
| Vinylene | 5.31-5.55 | 2 |
| Trisubstituted | 5.11-5.30 | 1 |

Mn may also be determined using a GPC-DRI method, as described below. For the purpose of the claims, Mn is determined by $^1H$ NMR. Mn, Mw, and Mz may be measured by using a Gel Permeation Chromatography (GPC) method using a High Temperature Size Exclusion Chromatograph (SEC, either from Waters Corporation or Polymer Laboratories), equipped with a differential refractive index detector (DRI). Experimental details, are described in: T. Sun, P. Brant, R. R. Chance, and W. W. Graessley, *Macromolecules*, Volume 34, Number 19, pp. 6812-6820, (2001) and references therein. Three Polymer Laboratories PLgel 10 mm Mixed-B columns are used. The nominal flow rate is 0.5 $cm^3$/min and the nominal injection volume is 300 μL. The various transfer lines, columns and differential refractometer (the DRI detector) are contained in an oven maintained at 135° C. Solvent for the SEC experiment is prepared by dissolving 6 grams of butylated hydroxy toluene as an antioxidant in 4 liters of Aldrich reagent grade 1,2,4-trichlorobenzene (TCB). The TCB mixture is then filtered through a 0.7 μm glass pre-filter and subsequently through a 0.1 μm Teflon filter. The TCB is then degassed with an online degasser before entering the SEC. Polymer solutions are prepared by placing dry polymer in a glass container, adding the desired amount of TCB, then heating the mixture at 160° C. with continuous agitation for about 2 hours. All quantities are measured gravimetrically. The TCB densities used to express the polymer concentration in mass/volume units are 1.463 g/mL at room temperature and 1.324 g/mL at 135° C. The injection concentration is from 1.0 to 2.0 mg/mL, with lower concentrations being used for higher molecular weight samples. Prior to running each sample the DRI detector and the injector are purged. Flow rate in the apparatus is then increased to 0.5 mL/minute, and the DRI is allowed to stabilize for 8 to 9 hours before injecting the first sample. The concentration, c, at each point in the chromatogram is calculated from the baseline-subtracted DRI signal, $I_{DRI}$, using the following equation:

$$c=K_{DRI}I_{DRI}/(dn/dc)$$

where $K_{DRI}$ is a constant determined by calibrating the DRI, and (dn/dc) is the refractive index increment for the system. The refractive index, n=1.500 for TCB at 135° C. and λ=690 nm. For purposes of this invention and the claims thereto, (dn/dc)=0.104 for propylene polymers and ethylene polymers, and 0.1 otherwise. Units of parameters used throughout this description of the SEC method are: concentration is expressed in g/cm$^3$, molecular weight is expressed in g/mol, and intrinsic viscosity is expressed in dL/g.

In an embodiment, the polyolefin useful as antiwear and corrosion inhibitor additives is derived from a vinyl terminated propylene polymer. In an embodiment, the vinyl terminated propylene polymer is produced using a process comprising: contacting propylene, under polymerization conditions, with a catalyst system comprising an activator and at least one metallocene compound represented by the formula:

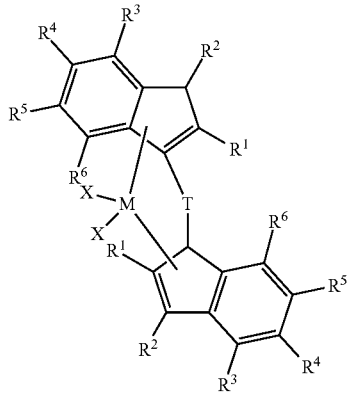

where:

M is hafnium or zirconium;

each X is, independently, selected from the group consisting of hydrocarbyl radicals having from 1 to 20 carbon atoms, hydrides, amides, alkoxides, sulfides, phosphides, halides, dienes, amines, phosphines, ethers, and a combination thereof, (two X's may form a part of a fused ring or a ring system);

each $R^1$ is, independently, a $C_1$ to $C_{10}$ alkyl group;

each $R^2$ is, independently, a $C_1$ to $C_{10}$ alkyl group;

each $R^3$ is hydrogen;

each $R^4$, $R^5$, and $R^6$, is, independently, hydrogen or a substituted hydrocarbyl or unsubstituted hydrocarbyl group, or a heteroatom;

T is a bridging group; and further provided that any of adjacent $R^4$, $R^5$, and $R^6$ groups may form a fused ring or multicenter fused ring system where the rings may be aromatic, partially saturated or saturated; and obtaining a propylene polymer having at least 50% allyl chain ends (relative to total unsaturations), as described in co-pending U.S. Ser. No. 13/072,280, filed Mar. 25, 2011, which is incorporated by reference in its entirety herein.

In an embodiment, the vinyl terminated propylene polymer is produced using a process comprising:

1) contacting:

a) one or more olefins with

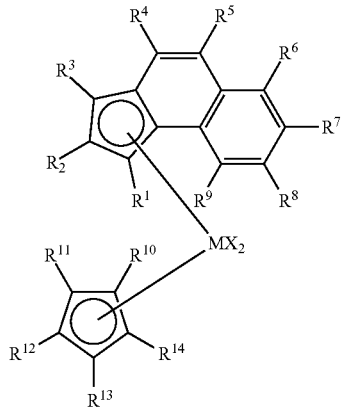

b) a transition metal catalyst compound represented by the formula:

wherein

M is hafnium or zirconium;

each X is, independently, selected from the group consisting of hydrocarbyl radicals having from 1 to 20 carbon atoms, hydrides, amides, alkoxides, sulfides, phosphides, halogens, dienes, amines, phosphines, ethers, or a combination thereof;

each $R^1$ and $R^3$ are, independently, a $C_1$ to $C_8$ alkyl group; and each $R^2$, $R^4$, $R^5$, $R^6$, $R^7$, $R^8$, $R^9$, $R^{10}$, $R^{11}$, $R^{12}$, $R^{13}$, and $R^{14}$ are independently, hydrogen, or a substituted or unsubstituted hydrocarbyl group having from 1 to 8 carbon atoms, provided however that at least three of the $R^{10}$-$R^{14}$ groups are not hydrogen; and 2) obtaining vinyl terminated polymer having an Mn of 300 g/mol or more and at least 30% allyl chain ends (relative to total unsaturation), as described in co-pending U.S. Ser. No. 13/072,279, filed Mar. 25, 2011, which is incorporated by reference in its entirety herein.

In an embodiment, the polyolefin chain is derived from a higher olefin copolymer comprising allyl chain ends. In an embodiment, the higher olefin copolymer comprising allyl chain ends has an Mn of 300 g/mol or more (measured by $^1$H NMR) comprising:

(i) from about 20 to about 99.9 mol % of at least one $C_5$ to $C_{40}$ higher olefin; and (ii) from about 0.1 mol % to about 80 mol % of propylene;

wherein the higher olefin copolymer has at least 40% allyl chain ends, as described in U.S. Ser. No. 13/072,249, filed Mar. 25, 2011, which is incorporated by reference in its entirety herein.

In an embodiment, the polyolefin chain is derived from a vinyl terminated branched polyolefin. In an embodiment, the vinyl terminated branched polyolefin has an Mn ($^1$H NMR) of 7,500 to 60,000 g/mol, comprising one or more alpha olefin derived units comprising ethylene and/or propylene, and having;

(i) 50% or greater allyl chain ends, relative to total number of unsaturated chain ends; and (ii) a $g'_{vis}$ of 0.90 or less, as described in U.S. Ser. No. 61/467,681, filed Mar. 25, 2011, which is incorporated by reference in its entirety herein.

In an embodiment, the polyolefin chain is derived from a vinyl terminated branched polyolefin produced by a process for polymerization, comprising:

(i) contacting, at a temperature greater than 35° C., one or more monomers comprising ethylene and/or propylene, with a catalyst system comprising a metallocene catalyst compound and an activator, wherein the metallocene catalyst compound is represented by the following formula:

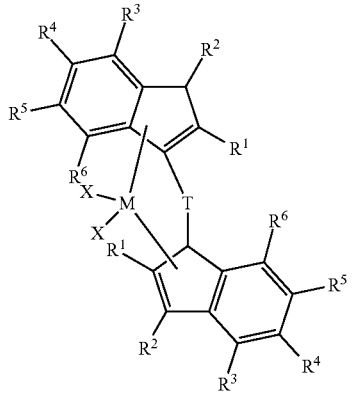

where: M is selected from the group consisting of zirconium or hafnium;

each X is, independently, selected from the group consisting of hydrocarbyl radicals having from 1 to 20 carbon atoms, hydrides, amides, alkoxides, sulfides, phosphides, halides, dienes, amines, phosphines, ethers, and a combination thereof, (two X's may form a part of a fused ring or a ring system);

each $R^1$, $R^2$, $R^3$, $R^4$, $R^5$, and $R^6$, is, independently, hydrogen or a substituted or unsubstituted hydrocarbyl group, a heteroatom or heteroatom containing group;

further provided that any two adjacent R groups may form a fused ring or multicenter fused ring system where the rings may be aromatic, partially saturated or saturated;

further provided that any of adjacent $R^4$, $R^5$, and $R^6$ groups may form a fused ring or multicenter fused ring system where the rings may be aromatic, partially saturated or saturated;

T is a bridging group represented by the formula $(Ra)_2J$, where J is one or more of C, Si, Ge, N or P, and each Ra is, independently, hydrogen, halogen, $C_1$ to $C_{20}$ hydrocarbyl or a $C_1$ to $C_{20}$ substituted hydrocarbyl, provided that at least one $R^3$ is a substituted or unsubstituted phenyl group, if any of $R^1$, $R^2$, $R^4$, $R^5$, or $R^6$ are not hydrogen;

(ii) converting at least 50 mol % of the monomer to polyolefin; and (iii) obtaining a branched polyolefin having greater than 50% allyl chain ends, relative to total unsaturated chain ends and a Tm of 60° C. or more, as described in U.S. Ser. No. 61/467,681, filed Mar. 25, 2011, which is incorporated by reference in its entirety herein.

In an embodiment, the polyolefin according to structure (I) includes a polyolefin chain ($R^1$) as described herein, and a pyridazine ring of structure (I) wherein $R^2$ and $R^3$ of the pyridazine moiety are independently H or substituted with one or more functional groups. The functional groups may be the same or different on a particular pyridazine ring.

In an embodiment, the polyolefin according to structure (I) includes $R^2$ and $R^3$ of the pyridazine moiety which are each H or a functional group comprising one or more hydrocarbyl group(s), one or more substituted hydrocarbyl group(s), or a combination thereof. In an embodiment, the polyolefin according to structure (I) includes $R^2$ and $R^3$ of the pyridazine moiety which are each H or a functional group comprising from 1 to 20 carbon atoms, nitrogen, oxygen, sulfur, phosphorous, or a combination thereof. In an embodiment, the polyolefin according to structure (I) includes $R^2$ and $R^3$ of the pyridazine moiety which are independently H, comprise one or more functional groups comprising atoms from Groups 13, 14, 15, 16, and 17 of the Periodic Table of Elements, or a combination thereof.

In an embodiment, at least one of $R^2$ and $R^3$ comprise H or a functional group selected from the group consisting of: $C_{1-20}$ linear alkyl, $C_{1-20}$ branched alkyl, $C_{1-20}$ cyclic alkyl, $C_{6-20}$ aromatic, $C_{7-20}$ alkyl-substituted aromatic, $C_{7-20}$ aryl-substituted alkyl, halogenated $C_{1-20}$ alkyl, $C_{1-20}$ alkyloxy, $C_{1-20}$ alkenyloxy, $C_{7-20}$ aryloxy, $C_{7-20}$ cycloalkyloxy, $C_{4-20}$ dienes, alkanol, alkanolamine, acetyl, acetamido, acetoacetyl, acetonyl, acetonylidene, acrylyl, alanyl, allophanoyl, anisyl, acetimido, amidino, amido, amino, aniline, anilino, arsino, azido, azino, azo, azoxy, benzamido, butyl, benzylidine, benzidyne, biphenyl), butylene, iso-butylene, sec-butylene, tert-butylene, carbonyl, carboxy, carbazoyl, caproyl, capryl, carbamido, carbamoyl, carbamyl, carbazoyl, chromyl, cinnamoyl, crotoxyl, cyanato, cyano, cyanamido, decanoly, disiloxanoxy, diazo, diazoamino, disilanyl, epoxy, ethenyl, ethynyl, formamido, formyl, furyl, furfuryl, furfurylideneyl, glutaryl, glycinamido, glycolyl, glycyl, glyocylyl, glycidyl, guanidino, guanyl, halo, hydroxyl, heptadecanoyl, heptanolyl, hydroperoxy, hydroxamino, hydroxylamido, hydrazido, heptanamido, hydrazino, hydrazo, hypophosphito, iodoso, isocyanato, isonitroso, imido, keto, lactyl, methacrylyl, malonyl, methylene, mercapto, methylenyl, nitroamino, nitro, nitrosamino, nitrosimino, nitrosylnitroso, nitrilo, naphthal, naphthobenzyl, naphthyl, naphthylidene, oxy, oxamido, peroxy, phosphinyl, phosphido, phosphito, phospho, phosphono, phosphoryl, isopropylidene, propylenyl, propylidenyl, pryidyl, pyrryl, phenethyl, phenylene, pyridino, phosphinyl, selenyl, seleninyl, selenonyl, siloxy, succinamyl, sulfamino, sulfamyl, sulfeno, silyl, silylenyl, sulfinyl, sulfo, sulfonyl, thiocarboxyl, toluoyl, thenyl, thienyl, thiobenzyl, thiocarbamyl, thiocarbonyl, thiocyanato, thionyl, thiuram, toluidino, tolyl, tolylenyl, tosyl, triazano, trihydrocarbylamino, trihaloamino, trihydrocarbyl trimethylene, trityl, tetrazinyl, ureayl, ureido, valeryl, vinylidenyl, xenyl, xylidino, xylyl, xylylenyl, and combinations thereof.

In an embodiment, at least one of $R^2$ and $R^3$ of the pyridazine moiety comprise a substituted or unsubstituted pyridyl functional group. In an embodiment, a polyolefin comprises one or more pyridazine moieties according to the following formulae:

(V)

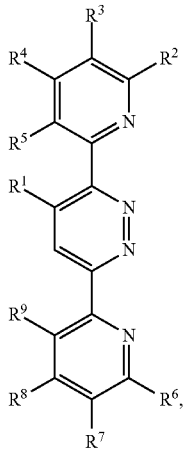

(VI)

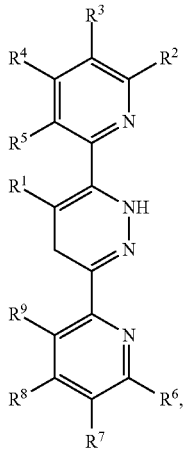

(VII)

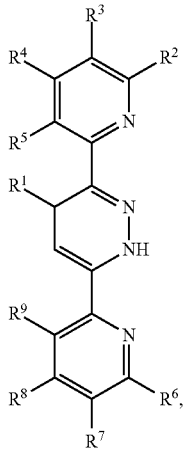

and

-continued (VIII)

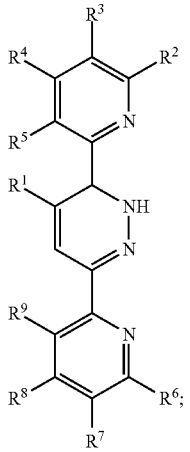

wherein $R^1$ comprises a polyolefin chain attached to the pyridazine moiety through an aliphatic linkage, and wherein $R^2$-$R^9$ ($R^2$, $R^3$, $R^4$, $R^5$, $R^6$, $R^7$, $R^8$, and $R^9$) each independently comprise H, one or more functional groups comprising atoms from Groups 13, 14, 15, 16, and 17 of the Periodic Table of Elements, or a combination thereof.

In an embodiment, a polyolefin comprises a pyridazine moiety attached to the backbone of a polymeric chain, wherein the pyridazine moiety is the cyclo-addition reaction product of a non-aromatic carbon-carbon double bond attached to a backbone of the polyolefin chain through a direct or an aliphatic linkage, and a substituted or unsubstituted tetrazine.

In an embodiment, the polyolefin is the reaction product between a tetrazine and an olefinic moiety attached to the polymer chain. Without wishing to be bound by theory, the inventors surmise that the vinyl terminated polyolefins act as electron rich olefins for an inverse electron demand Diels-Alder reaction. In particular, vinyl terminated polyolefins attached to a backbone of the polyolefin chain through an aliphatic linkage (and not through an aromatic linkage) are particularly useful. Additionally, the inventors have surprisingly found that the methods of the present invention have rates of reaction that are comparable to that of small alkenes. This is unexpected due to the disparity in size, architecture, sterics, and electronics of polymers compared to simple alkenes.

Accordingly, in an embodiment, the pyridazine moiety of the polyolefin (I), (II), (III), and/or (IV) is the cyclo-addition reaction product of a non-aromatic carbon-carbon double bond attached to a backbone of the polyolefin chain ($R^1$) through an aliphatic linkage (IX), and a substituted or unsubstituted tetrazine (X) according to the following reaction:

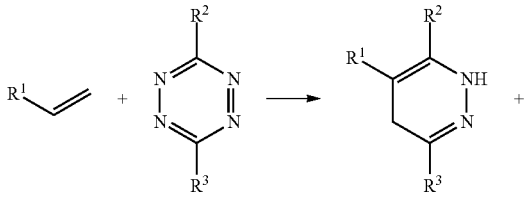

(IX) (X) (I)

-continued

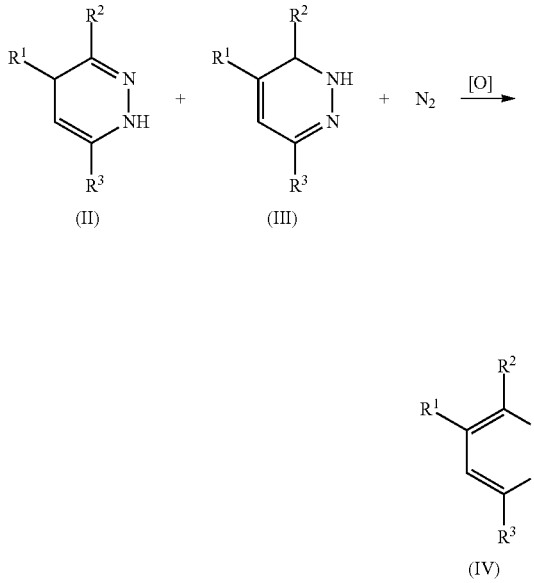

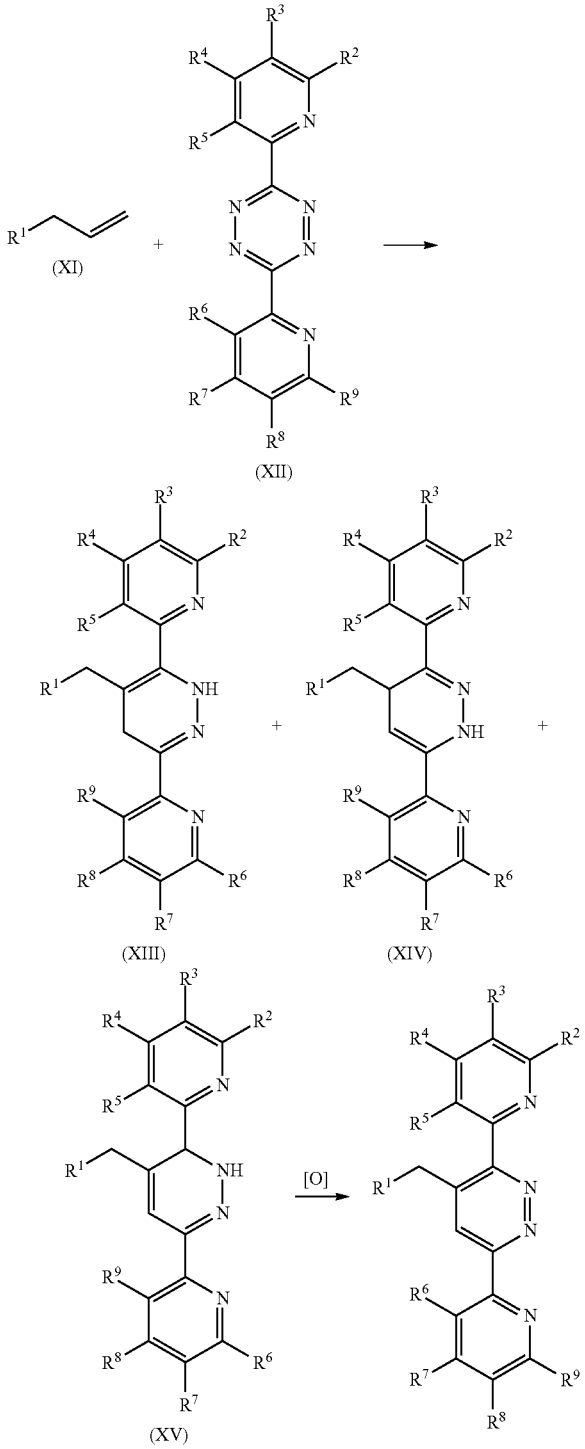

wherein $R^1$ comprises a polyolefin chain attached to the pyridazine moiety through an aliphatic linkage, and wherein $R^2$ and $R^3$ each independently comprise H or one or more functional groups as described herein, comprising atoms from Groups 13, 14, 15, 16, and 17 of the Periodic Table of Elements, or a combination thereof. Without wishing to be bound by theory, the inventors theorize that polyolefins (I), (II), and (III) have pyridazine moieties that are tautomers of each other. Under oxidative conditions, any of these tautomers may rearrange to produce the polyolefin (IV) in one embodiment; however, the inventive nature of the instant disclosure is not dependent on the particular path by which any of the polyolefins is produced. In embodiments herein, the conversion of the polyolefins (I), (II), and/or (III) to the polyolefin (IV) is attenuated by the presence of an oxidizing agent, represented in the reaction above as [O]. Any suitable oxidizing agent may be used. Preferably, the oxidizing agent is one or more of atmospheric oxygen, nitric acid, sulfuric acid, chromic acid, acetic acid, potassium chromate hydrate, and so on. Additional information on the oxidation of the dihydropyridazine ring may be found in U.S. Pat. No. 3,022,305.

In an embodiment, the tetrazine is substituted at $R^2$, $R^3$, or a combination thereof, with a functional group as described herein above. In some embodiments, useful tetrazines include 3,6-diphenyl-1,2,4,5-tetrazine, 3,6-di-2-pyridyl-1,2,4,5-tetrazine, 3,6-bis(2-chlorophenyl)-1,2,4,5-tetrazine, 3-(2-chlorophenyl)-6-(2,6-difluorophenyl)-1,2,4,5-tetrazine, and the like. In an embodiment, the pyridazine moiety of the polyolefins (XIII), (XIV), (XV), and (XVI) are the cyclo-addition reaction product of a vinyl terminated polyolefin (XI) and a di-pyridyl substituted tetrazine (XII) according to the following reaction:

wherein $R^1$ comprises a polyolefin chain attached to the pyridazine moiety through an aliphatic linkage, and wherein $R^2$-$R^9$ ($R^2$, $R^3$, $R^4$, $R^5$, $R^6$, $R^7$, $R^8$, and $R^9$) each independently comprise H or one or more functional groups comprising atoms from Groups 13, 14, 15, 16, and 17 of the Periodic Table of Elements, or a combination thereof. Without wishing to be bound by theory, the inventors theorize that polyolefins (XIII), (XIV) and (XV) have pyridazine moieties that are tautomers of each other. Under oxidative conditions, any of these tautomers may rearrange to produce the polyolefin (XVI) in one embodiment; however, the inventive nature of the instant disclosure is not dependent on the particular path by which any of the polyolefins is produced. In embodiments herein, the conversion of the polyolefins (XIII), (XIV), and/or (XV) to the polyolefin (XVI) is attenuated by the presence of an oxidizing agent, represented in the reaction above as [O]. Any suitable oxidizing agent may be used. Preferably, the oxidizing agent is one or more of atmospheric oxygen, nitric acid, sulfuric acid, chromic acid, acetic acid, potassium chromate hydrate, and so on. Additional information on the oxidation of the dihydropyridazine ring may be found in U.S. Pat. No. 3,022,305. In an embodiment, the tetrazine (XII) contacted with the vinyl terminated polyolefin is 3,6-di-2-pyridyl-1,2,4,5-tetrazine ($R^2$-$R^9$=H).

In any embodiment, the $R^2$ and $R^3$ functional groups can be further reacted to produce other functional groups to further modify the polyolefin for a particular end use.

Lubricant Compositions:

Some embodiments herein relate to a lubricant composition comprising: (a) a lube oil base stock, and (b) a zero SAP antiwear additive and/or corrosion inhibitor additive comprising at least one functionalized polymer comprising one or more pyridazine moieties according to the following formulae:

(I)

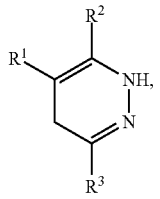

(II)

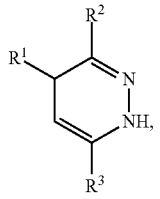

(III)

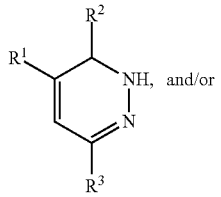

and/or (IV)

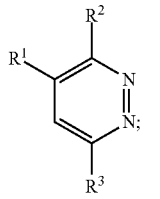

wherein $R^1$ comprises a polyolefin chain attached to the pyridazine moiety through an aliphatic linkage; and wherein $R^2$ and $R^3$ each comprise H or one or more functional groups comprising atoms from Groups 13, 14, 15, 16, and 17 of the Periodic Table of Elements, or a combination thereof.

In another embodiment of the present disclosure, a lubricant composition includes: (a) a lube base stock and (b) antiwear additive and/or corrosion inhibitor additive comprising a polyolefin functionalized with an amine, or an aromatic amine, or pyridines, may be further reacted with an acid and then with a clay to produce a polymer modified clay. In a particular embodiment, a polyolefin functionalized according to the present disclosure with an amine, an aromatic amine, or a pyridine is acidified to produce cationic amine functional groups which can displace sodium ions or other ions found in a clay.

In some embodiments, the composition further comprises at least one phr of a graphite or graphene to further reduce friction and improve anti-wear performance. The amount of graphite or graphene incorporated in the polymer-graphite or graphene composition is generally that which is sufficient to develop an improvement in the antiwear and friction reducing properties of the composition. Amounts generally will be in the range of 0.5 to 10 wt % in one embodiment, and in the range of 1 to 5 wt % in another embodiment, based on the polymer content of the composition. Expressed in parts per hundred, the graphite or graphene may be present in amounts greater than 1 phr, preferably in the range of 1 to 30 phr in one embodiment, and in the range of 5 to 20 phr in another embodiment. The graphite or graphene particle size is generally nano-scale or larger.

In an embodiment, the tetrazine in the functionalized polymeric or oligomeric zero SAP antiwear additive and/or corrosion inhibitor additive comprises pyridyl or other amine functional groups suitable to form complexes with various metals. In an embodiment, $R^1$ may be an ethylene-diene copolymer, which may include ethylene-norbornene copolymers and the like, to produce modified polyolefins suitable to form a complex with one or more metals to produce a functionalized polymer suitable for use as coating, anti-fouling coating, metal composite, metal complex, or the like. In an embodiment, a polyolefin functionalized with an amine, or an aromatic amine, or pyridines may be further used to treat metal surfaces by contacting a metal surface with a functionalized polyolefin under conditions sufficient to produce co-ordinate bonds between the metal surface and the functional groups, to produce a monolayer, one or more layers of a bi-layer, or other type of film of the functionalized polyolefin on the metal surface.

In an embodiment, a functionalized polyolefin as a zero SAP antiwear and/or corrosion inhibitor additive may be complexed with metal atoms such as Cu, Ag, Fe, and the like to produce supramolecular chemical structures.

Functionalized polyolefins of the present invention having uses as zero SAP antiwear and/or corrosion inhibitor additives typically have Mns (g/mol) of less than 20,000, preferably less than 10,000 and most preferably less than 8,000 and typically can range from 500 to 10,000 (e.g., 500 to 5,000), preferably from 1,000 to 8,000 (e.g., 1,000 to 5,000) and most preferably from 1,500 to 6,000 (e.g., 1,500 to 3,000).

Other Lubricant and Hydrocarbon Fluid Additives

The lubricating oil compositions and hydrocarbon fluids of the instant disclosure may also additional additives in effective amounts to further improve the functionality and properties of the lubricating oil compositions and hydrocarbon fluids. Non-limiting exemplary performance additives include oxidation inhibitors, metallic and non-metallic dispersants, metallic and non-metallic detergents, metal deactivators, anti-seizure agents, pour point depressants, wax modifiers, viscosity modifiers, seal compatibility agents, lubricity agents, anti-staining agents, chromophoric agents, defoamants, demulsifiers, and others. For a review of many commonly used additives see Klamann in Lubricants and Related Products, Verlag Chemie, Deerfield Beach, Fla.; ISBN 0-89573-177-0, which also gives a good discussion of a number of the lubricant additives mentioned below. Reference is also made "Lubricant Additives" by M. W. Ranney, published by Noyes Data Corporation of Parkridge, N.J. (1978).

The types and quantities of performance additives used in combination with the instant invention in lubricant compositions and hydrocarbon fluids are not limited by the examples shown herein as illustrations.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example, each of which is incorporated by reference herein in its entirety.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

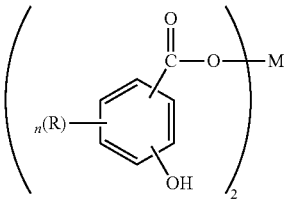

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791 for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, preferably, about 0.1 to 0.4 wt %.

Dispersant:

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule, which confers solubility in the oil, is normally a polyisobutylene group. Many examples of this type of dispersant are well known commercially and in the literature. Exemplary U.S. patents describing such dispersants are 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433; 3,822,209 and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Antifoam Agents

Antifoam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; WO 99/66013; WO 99/47629; WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below. The total of the additional additives in the lubricating oil composition may range from 1 to 20 wt. % of the composition, or 2 to 18 wt. %, or 3 to 15 wt. %, or 4 to 10 wt. %, or 5 to 8 wt. %.

Note that many of the additives are shipped from the manufacturer and used with a certain amount of base oil solvent in the formulation. Accordingly, the weight amounts in the table below, as well as other amounts mentioned in this patent, unless otherwise indicated are directed to the amount of active ingredient (that is the non-solvent portion of the ingredient). The wt % indicated below are based on the total weight of the lubricating oil composition.

TABLE 1

Typical Amounts of Various Lubricant Oil Components

| Compound | Approximate wt % (useful) | Approximate wt % (preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base stock or base oil | Balance | Balance |

The present disclosure, accordingly, provides the following embodiments:

1. A lubricant composition including one or more base oils and an effective amount of at least one zero SAP antiwear and/or corrosion inhibitor additive comprising a polyolefin comprising one or more pyridazine moieties according to the following formulae:

(I)

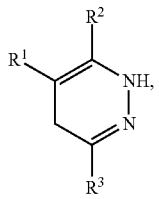

-continued (II)

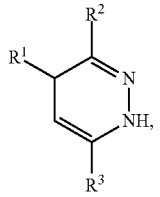

(III)

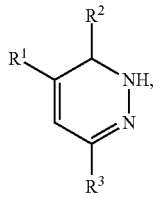

and/or (IV)

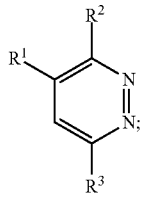

wherein $R^1$ comprises a polyolefin chain attached to the pyridazine moiety (preferably the pyridazine moiety is a terminal moiety of the polyolefin chain) through an aliphatic linkage; and wherein $R^2$ and $R^3$ each comprise H or one or more functional groups comprising atoms from Groups 13, 14, 15, 16, and 17 of the Periodic Table of Elements, or a combination thereof (preferably at least one of $R^2$ and $R^3$ comprises from 1 to 20 carbon atoms, nitrogen, oxygen, sulfur, phosphorous, or a combination thereof; preferably at least one of $R^2$ and $R^3$ comprise a functional group selected from the group consisting of:

$C_{1-20}$ linear alkyl, $C_{1-20}$ branched alkyl, $C_{1-20}$ cyclic alkyl, $C_{6-20}$ aromatic, $C_{7-20}$ alkyl-substituted aromatic, $C_{7-20}$ aryl-substituted alkyl, halogenated $C_{1-20}$ alkyl, $C_{1-20}$ alkyloxy, $C_{1-20}$ alkenyloxy, $C_{7-20}$ aryloxy, $C_{7-20}$ cycloalkyloxy, $C_{4-20}$ dienes, alkanol, alkanolamine, acetyl, acetamido, acetoacetyl, acetonyl, acetonylidene, acrylyl, alanyl, allophanoyl, anisyl, acetimido, amidino, amido, amino, aniline, anilino, arsino, azido, azino, azo, azoxy, benzamido, butyl, benzylidine, benzidyne, biphenyl), butylene, iso-butylene, sec-butylene, tert-butylene, carbonyl, carboxy, carbazoyl, caproyl, capryl, carbamido, carbamoyl, carbamyl, carbazoyl, chromyl, cinnamoyl, crotoxyl, cyanato, cyano, cyanamido, decanoly, disiloxanoxy, diazo, diazoamino, disilanyl, epoxy, ethenyl, ethynyl, formamido, formyl, furyl, furfuryl, furfurylideneyl, glutaryl, glycinamido, glycolyl, glycyl, glyocylyl, glycidyl, guanidino, guanyl, halo, hydroxyl, heptadecanoyl, heptanolyl, hydroperoxy, hydroxamino, hydroxylamido, hydrazido, heptanamido, hydrazino, hydrazo, hypophosphito, iodoso, isocyanato, isonitroso, imido, keto, lactyl, methacrylyl, malonyl, methylene, mercapto, methylenyl, nitroamino, nitro, nitrosamino, nitrosimino, nitrosylnitroso, nitrilo, naphthal, naphthobenzyl, naphthyl, naphthylidene, oxy, oxamido, peroxy, phosphinyl, phosphido, phosphito, phospho, phosphono, phosphoryl, isopropylidene, propylenyl, propylidenyl, pryidyl, pyrryl, phenethyl, phenylene, pyridino, phosphinyl, selenyl, seleninyl, selenonyl, siloxy, succinamyl, sulfamino, sulfamyl, sulfeno, silyl, silylenyl, sulfinyl, sulfo, sulfonyl, thiocarboxyl, toluoyl, thenyl, thienyl, thiobenzyl, thiocarbamyl, thiocarbonyl, thiocyanato, thionyl, thiuram, toluidino, tolyl, tolylenyl, tosyl, triazano, trihydrocarbylamino, trihaloamino, trihydrocarbyl trimethylene, trityl, tetrazinyl, ureayl, ureido, valeryl, vinylidenyl, xenyl, xylidino, xylyl, xylylenyl, and combinations thereof; preferably at least one of $R^2$ and $R^3$ comprise a pyridyl functional group).

2. The composition of claim 1, wherein $R^1$ of the polyolefin comprises a $C_{2-20}$ poly-alpha-olefin having a weight average molecular weight of greater than or equal to about 2,500 g/mol (preferably $R^1$ is derived from polyethylene, polypropylene, polybutadiene, butyl rubber, or a combination thereof) or, $R^1$ is derived from one or more of:

(i) a vinyl terminated polymer having at least 5% allyl chain ends;

(ii) a vinyl terminated polymer having an Mn of at least 200 g/mol (measured by $^1$H NMR) comprising of one or more $C_4$ to $C_{40}$ higher olefin derived units, where the higher olefin polymer comprises substantially no propylene derived units; and wherein the higher olefin polymer has at least 5% allyl chain ends;

(iii) a copolymer having an Mn of 300 g/mol or more (measured by $^1$H NMR) comprising (a) from about 20 mol % to about 99.9 mol % of at least one $C_5$ to $C_{40}$ higher olefin, and (b) from about 0.1 mol % to about 80 mol % of propylene, wherein the higher olefin copolymer has at least 40% allyl chain ends;

(iv) a copolymer having an Mn of 300 g/mol or more (measured by $^1$H NMR), and comprises (a) from about 80 mol % to about 99.9 mol % of at least one $C_4$ olefin, (b) from about 0.1 mol % to about 20 mol % of propylene; and wherein the vinyl terminated macromonomer has at least 40% allyl chain ends relative to total unsaturation;

(v) a co-oligomer having an Mn of 300 g/mol to 30,000 g/mol (measured by $^1$H NMR) comprising 10 mol % to 90 mol % propylene and 10 mol % to 90 mol % of ethylene, wherein the oligomer has at least X % allyl chain ends (relative to total unsaturations), where: 1) X=(−0.94*(mol % ethylene incorporated)+100), when 10 mol % to 60 mol % ethylene is present in the co-oligomer, 2) X=45, when greater than 60 mol % and less than 70 mol % ethylene is present in the co-oligomer, and 3) X=(1.83*(mol % ethylene incorporated)−83), when 70 mol % to 90 mol % ethylene is present in the co-oligomer;

(vi) a propylene oligomer, comprising more than 90 mol % propylene and less than 10 mol % ethylene wherein the oligomer has: at least 93% allyl chain ends, a number average molecular weight (Mn) of about 500 g/mol to about 20,000 g/mol, an isobutyl chain end to allylic vinyl group ratio of 0.8:1 to 1.35:1.0, and less than 100 ppm aluminum;

(vii) a propylene oligomer, comprising: at least 50 mol % propylene and from 10 mol % to 50 mol % ethylene, wherein the oligomer has: at least 90% allyl chain ends, an Mn of about 150 g/mol to about 10,000 g/mol, and an isobutyl chain end to allylic vinyl group ratio of 0.8:1 to 1.2:1.0, wherein monomers having four or more carbon atoms are present at from 0 mol % to 3 mol %;

(viii) a propylene oligomer, comprising: at least 50 mol % propylene, from 0.1 mol % to 45 mol % ethylene, and from 0.1 mol % to 5 mol % $C_4$ to $C_{12}$ olefin, wherein the oligomer has: at least 90% allyl chain ends, an Mn of about 150 g/mol to about 10,000 g/mol, and an isobutyl chain end to allylic vinyl group ratio of 0.8:1 to 1.35:1.0;

(ix) a propylene oligomer, comprising: at least 50 mol % propylene, from 0.1 mol % to 45 mol % ethylene, and from 0.1 mol % to 5 mol % diene, wherein the oligomer has: at least 90% allyl chain ends, an Mn of about 150 g/mol to about 10,000 g/mol, and an isobutyl chain end to allylic vinyl group ratio of 0.7:1 to 1.35:1.0; and (x) a homo-oligomer, comprising propylene, wherein the oligomer has: at least 93% allyl chain ends, an Mn of about 500 g/mol to about 20,000 g/mol, an isobutyl chain end to allylic vinyl group ratio of 0.8:1 to 1.2:1.0, and less than 1400 ppm aluminum.

3. The composition of paragraphs 1 and 2, wherein the pyridazine moiety of the polyolefin is the cyclo-addition reaction product of a non-aromatic carbon-carbon double bond (preferably a terminal vinyl functional group) attached to a backbone of the polyolefin chain through an aliphatic linkage, and a substituted or unsubstituted tetrazine (preferably the tetrazine is one of 3,6-diphenyl-1,2,4,5-tetrazine, 3,6-di-2-pyridyl-1,2,4,5-tetrazine, 3,6-bis(2-chlorophenyl)-1,2,4,5-tetrazine, 3-(2-chlorophenyl)-6-(2,6-difluorophenyl)-1,2,4,5-tetrazine, and the like).

4. A method to produce the polyolefin of paragraphs 1 to 3 comprising:

contacting a first polyolefin comprising at least one non-aromatic carbon-carbon double bond (preferably the first polyolefin is vinyl terminated) with a substituted or unsubstituted tetrazine (preferably 3,6-diphenyl-1,2,4,5-tetrazine, 3,6-di-2-pyridyl-1,2,4,5-tetrazine, 3,6-bis(2-chlorophenyl)-1,2,4,5-tetrazine, 3-(2-chlorophenyl)-6-(2,6-difluorophenyl)-1,2,4,5-tetrazine, and the like) at a temperature and for a period of time sufficient to produce a second polyolefin comprising one or more pyridazine moieties according to the following formulae:

(I)

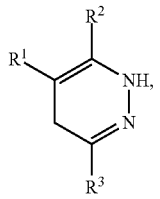

(II)

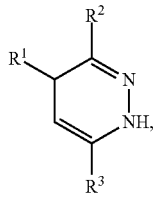

(III)

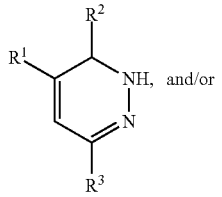

and/or (IV)

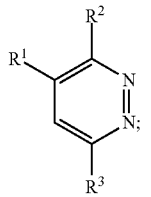

wherein R1 comprises the first polyolefin attached to the pyridazine moiety through an aliphatic linkage, and wherein R2 and R3 each comprise H or one or more functional groups comprising atoms from Groups 13, 14, 15, 16, and 17 of the Periodic Table of Elements, or a combination thereof.

EXAMPLES

Product Characterization

Products were characterized by $^{1}H$ NMR and $^{13}C$ NMR as follows:

$^{1}H$ NMR $^{1}H$ NMR data was collected at either room temperature or 120° C. (for purposes of the claims, 120° C. shall be used) in a 5 mm probe using a spectrometer with a $^{1}H$ frequency of at least 400 MHz. Data was recorded using a maximum pulse width of 45° C., 8 seconds between pulses and signal averaging 120 transients.

$^{13}C$ NMR $^{13}C$ NMR data was collected at 120° C. using a spectrometer with a $^{13}C$ frequency of at least 100 MHz. A 90 degree pulse, an acquisition time adjusted to give a digital resolution between 0.1 and 0.12 Hz, at least a 10 second pulse acquisition delay time with continuous broadband proton decoupling using swept square wave modulation without gating was employed during the entire acquisition period. The spectra were acquired with time averaging to provide a signal to noise level adequate to measure the signals of interest. Samples were dissolved in tetrachloroethane-$d_2$ (TCE) at concentrations between 10 to 15 wt % prior to being inserted into the spectrometer magnet.

Prior to data analysis spectra were referenced by setting the chemical shift of the TCE solvent signal to 74.39 ppm.

Example 1

A vinyl terminated polypropylene oligomer (5.377 grams, 0.84 mmol) having a Mw of 6,400 g/mol and 98 wt % vinyl chain ends (determined by $^{1}H$ NMR) was combined in a glass vial at a 0.5:1 stoichiometric amount with 3,6-di-2-pyridyl-1,2,4,5-tetrazine (0.42 mmol, Mw 236 g/mol, 99.1 mg), which was added as a dry red powder. A magnetic stir bar was added to the vial which was then heated to 170° C. with 500 rpm mixing. Once no observable bubbles could be seen (after about 25 minutes), the sample was cooled to room temperature and observed to be a transparent orange viscous liquid (Sample A).

Example 2

A BRABENDER mixer was preheated to 200° C. for 10 minutes, cooled to 190° C. and to this a mixture of a vinyl terminated polyethylene (PAXON EA55003, ExxonMobil Chemical Corporation, 50 g, Mn 17,000 g/mol, 2.94 mmol, 95%+ vinyl chain ends) and 3,6-di-2-pyridyl-1,2,4,5-tetrazine (0.7 g, Mn=236 g/mol, 2.96 mmol) was added. The sample was seen to become a viscous dark red cloudy melt. After 10 minutes, the mixture was seen to have become a translucent orange melt and an additive package of 25 mg IRGANOX 1076, 100 mg IRGAFOS 168 (available from BASF Corporation) and 40 mg DYNAMAR FX5920A (available from Dyneon LLC, Oakdale, Minn.) was added. The reaction mixture was blended for 5 minutes further to produce Sample B.

Example 3 (Comparative)

The comparative sample was produced using the same procedure as in Example 1, but without the tetrazine addition. This sample is a control (Comparative Sample C).

Figure 1B:
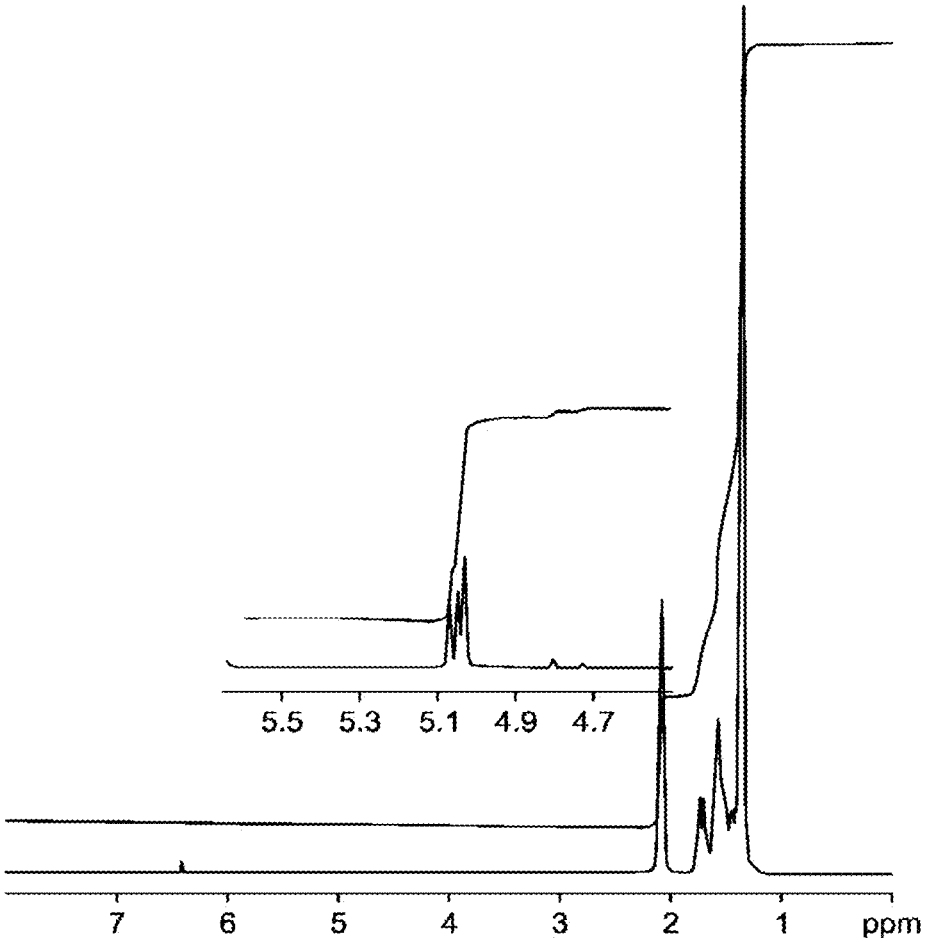
FIG. 1B is a $^1$H NMR spectrum of a functionalized polyolefin according to an embodiment of this invention.
Figure 1C:
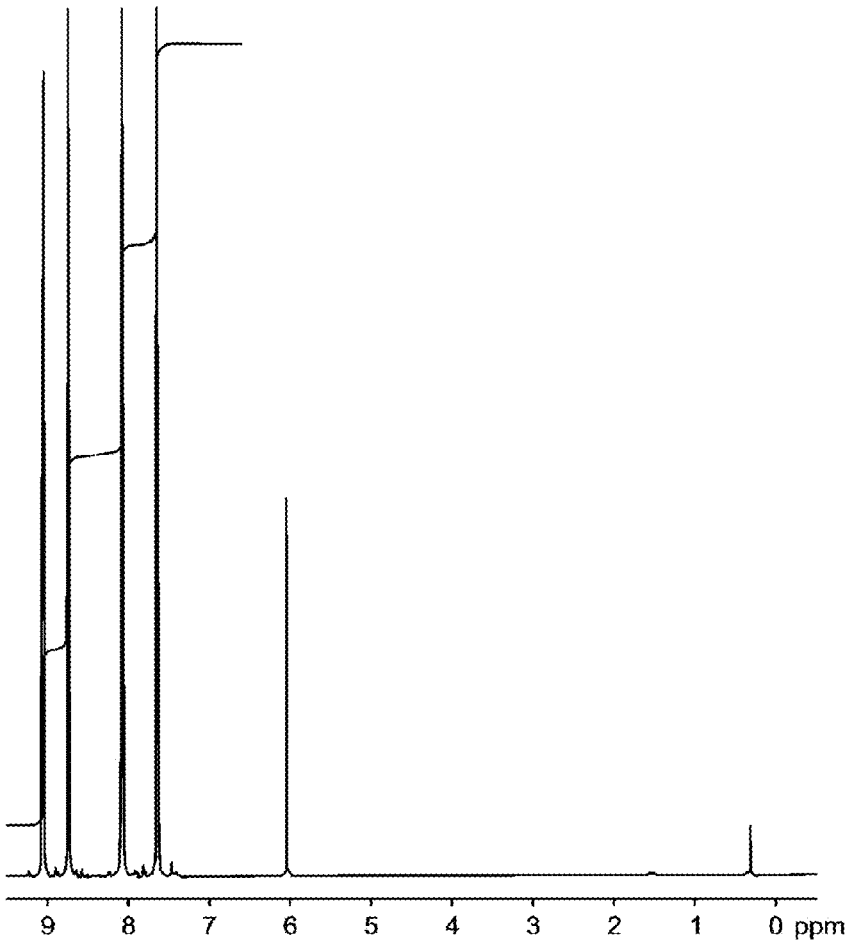
FIG. 1C is a $^1$H NMR spectrum of 3,6-di-2-pyridyl-1,2,4,5-tetrazine in tetrachloroethane.
Figure 1D:
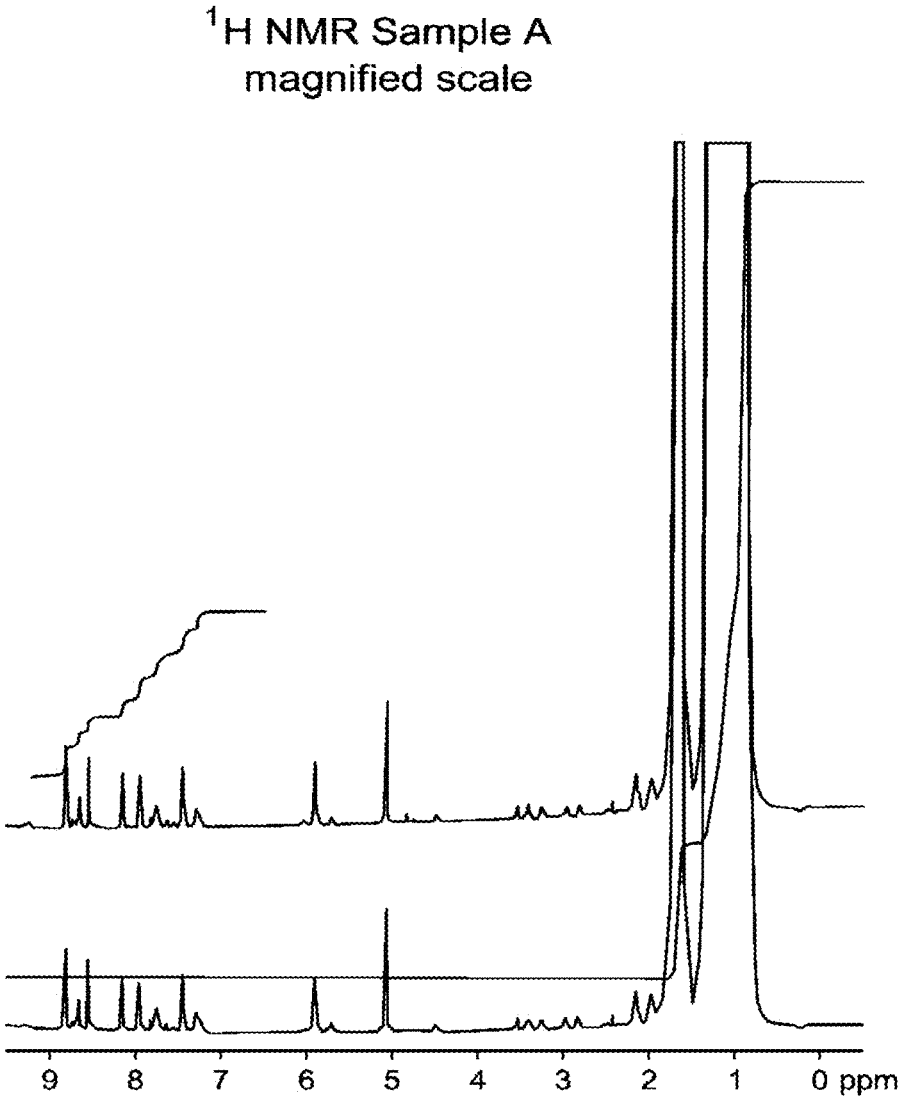
FIG. 1D is a $^1$H NMR spectrum of a functionalized polyolefin according to an embodiment of this invention.

FIG. 1A shows the $^{1}H$ NMR spectrum of the vinyl terminated polypropylene of Example 1, which has a vinyl content of 1.98 carbons/1000 carbons. FIG. 1B shows the $^{1}H$ NMR spectrum of Sample A, which shows a vinyl content of 1.02 carbons/1000 carbons, which indicates 48.5% of the vinyl carbons originally present on the vinyl terminated polypropylene have reacted. This is in accordance with what would be expected for the 0.484:1 stoichiometric ratio used (considering the Aldrich specified 96+% purity). The remaining vinyl groups remain unreacted. FIG. 1C shows the $^1$H NMR spectrum of 3,6-di-2-pyridyl-1,2,4,5-tetrazine in tetrachloroethane. FIG. 1D shows the $^1$H NMR spectrum of Sample A on a magnified scale, which is compared to that of 3,6-di-2-pyridyl-1,2,4,5-tetrazine shown in FIG. 1C. The peaks at 8.99, 8.75, 8.01, and 7.58 have been previously assigned to the (6,6'), (3,3'), (4,4'), and (5,5') protons of the pyridine ring. The 8.99 ppm peak completely disappears in the final polymer and all peaks are seen to have been shifted upfield. The peaks are also seen to be split which is expected once the reaction converting the symmetric tetrazine to an asymmetric pyridazine has happened. The 5 peaks between 7 to 8.2 ppm can be integrated into 5 protons of equal height and the region between 8.4 ppm and 9.0 ppm corresponds to 3 more protons. The 8 protons of the pyridine rings remain intact.

FIG. 2 shows the complex viscosity versus frequency plot of vinyl terminated polyethylene starting material of Example 2, Sample B, and Comparative Sample C. As the data show, no significant change in rheological behavior is seen between the functionalized polymer according to the present disclosure and that of the original polymer. The lack of change of viscosity at similar frequencies between the two samples shows that there was no significant cross linking or chain scission during the reaction of the polyethylene with the tetrazine. Accordingly, the functionalized polymer advantageously retains its rheological behavior.

Figure 3A:
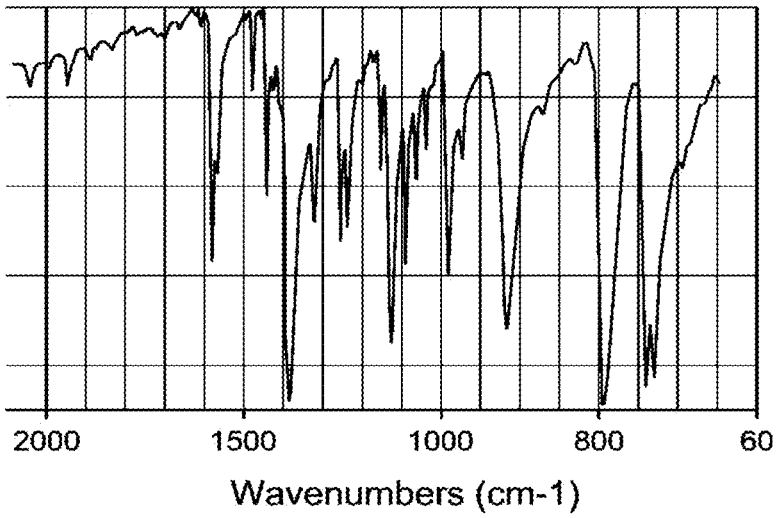
FIG. 3A is a Fourier transform infrared (FTIR) spectrum of 3,6-di-2-pyridyl-1,2,4,5-tetrazine.
Figure 3B:
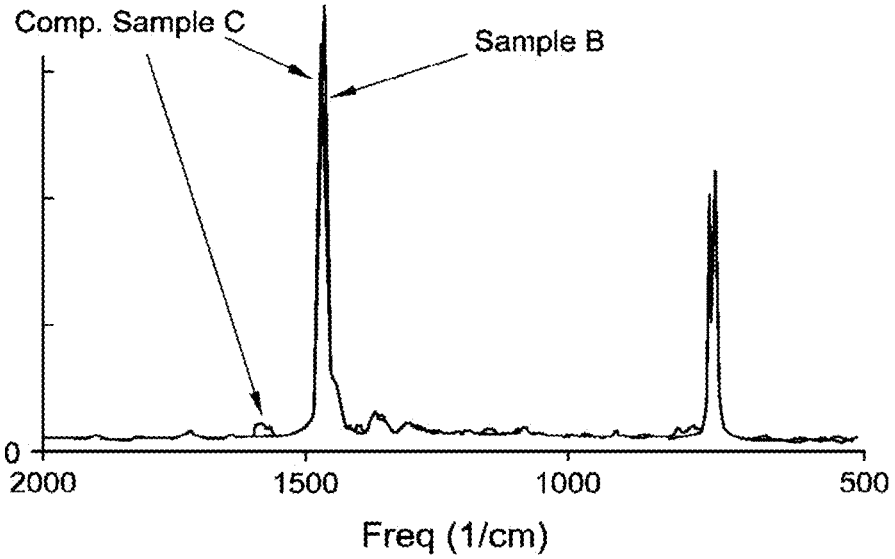
FIG. 3B is a partial FTIR spectrum of a functionalized polyolefin according to an embodiment of this invention and a Comparative Sample.

FIG. 3A shows the FTIR spectrum for 3,6-di-2-pyridyl-1,2,4,5-tetrazine and FIG. 3B shows the FTIR spectrum of Sample B from Example 2 compared to Comparative Sample C. The four peaks visible in the region of 1550-1580 $cm^{-1}$ confirm the C—N groups and these are shifted with respect to the location of the two peaks of base material in the same region.

The analysis using NMR and FTIR gives an indication that the vinyl terminated polyolefins were successfully end functionalized. This functional group is a dipyridyl pyridazine and is weakly basic.

Example 4

In another example, a BRABENDER mixer was heated to 190° C. and to this 50 grams of vinyl terminated polyethylene (PAXON EA55-003, ExxonMobil) granules (95% vinyl terminated, determined by $^1$H NMR) was added with 0.35 grams of bipyridyl tetrazine (3,6-di-2-pyridyl-1,2,4,5-tetrazine, 0.5 mol tetrazine groups per 1 mol vinyl groups). The mixture was mixed at 40 rpm for 10 minutes after which 0.255 grams of dried p-toluene sulphonic acid was added (1 mol acid per 1 mol tetrazine groups). An additive package consisting of IRGANOX 1076 (500 ppm), IRGAFOS 168 (1000 ppm), and DYNAMAR 5920 (800 ppm) was also added at this time. After 5 minutes of additional mixing, 2.5 grams (to obtain 5 wt %) of dried montmorillonite clay was added. The sample was mixed for 5 minutes further and removed from the BRABENDER. The maroon colored sample produced was a functionalized polymer modified clay wherein the functionalized polyolefin was bonded to the clay.

Kinetics Studies

Kinetics Study of the Reaction Between Vinyl Terminated Polypropylene and 3,6-di-2-pyridyl-1,2,4,5-tetrazine In a 20 ml vial, 1.6 g (1.0 mmol) of atactic polypropylene ($M_n$=1.6 k g/mol, vinyl content=93%) was dissolved in 4 ml of 1,1,2,2-tetrachloroethane-$d_2$ (TCE-$d_2$). 3,6-di-2-pyridyl-1,2,4,5-tetrazine (DPTZ, 0.28 g, 1.2 mmol) was dissolved in 2 ml TCE-$d_2$, and then was transferred to the reaction vial containing atactic polypropylene. The vial was placed onto a preheated hotplate stirrer at 60° C. and an initial sample was taken. Samples were taken at different time intervals during the reaction for $^1$H NMR analysis to monitor the reaction progress. Kinetics studies at 40° C. were carried out in a similar fashion. Table 1 shows the progress of the reaction (%) monitored by vinyl bond conversion.

TABLE 1

Kinetic Data For The Reaction Between Atactic Polypropylene And DPTZ

| Time (minutes) | Reaction Progress (%) 40° C. | 60° C. |
|---|---|---|
| 0 | 0% | 10% |
| 10 | 20% | — |
| 30 | 35% | — |
| 60 | 50% | 94% |
| 120 | 61% | 100% |
| 180 | 63% | — |
| 240 | 66% | — |

Kinetics Study of the Reaction Between $C_{10}$ Alkenes and 3,6-di-2-pyridyl-1,2,4,5-tetrazine The alkenes (1-decene, 2-methyl-1-nonene and 5-decene, 0.11 g (0.8 mmol) each) were dissolved in 6 ml $CDCl_3$. DPTZ (0.56 g, 2.4 mmol) was dissolved into 12 ml $CDCl_3$ and added to the solution of alkenes. The solution was immediately evenly divided into 3 vials which were placed on pre-heated hotplate stirrer at room temperature (22° C.), 40° C. and 60° C. respectively. Initial samples were taken at this time (time 0 minutes), and samples were taken at different intervals during the reaction. $^1$H NMR analysis was used to monitor the reaction progress, and the data is reported in Table 2. All values reported are the mole fractions of double bonds (at original peak location) remaining in the sample. Vinylidene peaks were located at 4.7 ppm, vinyl peaks at 5.0 ppm and vinylene peaks at 5.4 ppm.

TABLE 2

Kinetic Data for the Reactin Between $C_{10}$ Alkenes and DPTZ

| | Temp. | | | | | | | | |
|---|---|---|---|---|---|---|---|---|---|
| | 22° C. | | | 40° C. | | | 60° C. | | |
| Time (mins) | Vinylidene | Vinyl | Vinylene | Vinylidene | Vinyl | Vinylene | Vinylidene | Vinyl | Vinylene |
| 0 | 0.33 | 0.33 | 0.33 | 0.33 | 0.33 | 0.33 | 0.33 | 0.33 | 0.33 |
| 10 | 0.32 | 0.34 | 0.34 | 0.36 | 0.30 | 0.34 | 0.38 | 0.24 | 0.37 |

TABLE 2-continued

Kinetic Data for the Reactin Between $C_{10}$ Alkenes and DPTZ

| | Temp. | | | | | | | | |
|---|---|---|---|---|---|---|---|---|---|
| | 22° C. | | | 40° C. | | | 60° C. | | |
| Time (mins) | Vinylidene | Vinyl | Vinylene | Vinylidene | Vinyl | Vinylene | Vinylidene | Vinyl | Vinylene |
| 20 | 0.34 | 0.34 | 0.32 | 0.37 | 0.27 | 0.36 | 0.40 | 0.19 | 0.40 |
| 30 | 0.35 | 0.32 | 0.33 | 0.38 | 0.25 | 0.37 | 0.42 | 0.15 | 0.43 |
| 60 | 0.36 | 0.27 | 0.37 | 0.42 | 0.18 | 0.40 | 0.48 | 0.06 | 0.46 |
| 90 | 0.37 | 0.22 | 0.41 | — | — | — | 0.51 | 0.00 | 0.49 |
| 120 | 0.38 | 0.21 | 0.40 | 0.45 | 0.09 | 0.46 | — | — | — |
| 180 | 0.42 | 0.15 | 0.43 | — | — | — | 0.51 | 0.00 | 0.49 |
| 240 | 0.44 | 0.12 | 0.44 | 0.50 | 0.00 | 0.50 | 0.54 | 0.00 | 0.46 |

The data shows that the vinyl bond reacts preferentially with the tetrazine. The reactivity of the vinylene and vinylidene are similar to each other and the reaction rate is much slower than the vinyl bond. The data also shows that the reaction rate of the above reaction with atactic polypropylene is surprisingly very similar to that with the small molecule decene (for example, at 60° C. reaction is complete in 90 minutes with decene and 120 minutes with atactic polypropylene).

Example 5

Synthesis of a Vinyl Terminated Atactic Polypropylene (aPP1)

A vinyl terminated aPP was prepared in a continuous solution reactor at 60° C. using a rac-$Me_2Si$(2-methyl,3-propylindenyl)$_2$hafnium dimethyl(metallocene) catalyst activated with a dimethyl-anilinium-tetrakis(perfluoronaphthyl)borate (activator 1). The metallocene catalyst was premixed with the activator 1 in a 1:1.05 ratio and fed into the reactor at a rate of 3.3×10-7 moles/minute. The monomer propylene was fed into the reactor at a rate of 15 g/minute, the isohexane solvent was fed at a rate of 59.4 g/minute, and a tri-n-octylaluminum (the second activator) was fed at a rate of 5.2×10-6 moles/minute. The aPP1 thus synthesized has a molecular weight of 6,400 g/mol and with 98% vinyl chain ends by NMR.

Example 6

Preparation of aPP-tetrazne (aPPt)

To a glass vial, 7.6449 grams of aPP1 was added followed by 3,6-di-2-pyridyl-1,2,4,5-tetrazine (298.2 mg) added as a dry red powder. A magnetic stir bar was then added and the vial was heated to 170° C. with 800 rpm mixing for 30 minutes. The resulting aPPt product was observed to be a translucent orange viscous liquid where 85% conversion of the vinyl double bond was shown by $^1$H NMR. The reaction between a vinyl terminated polyolefin (PO) (aPP1) and tetrazine (di-pyridyl tetrazine) is illustrated below.

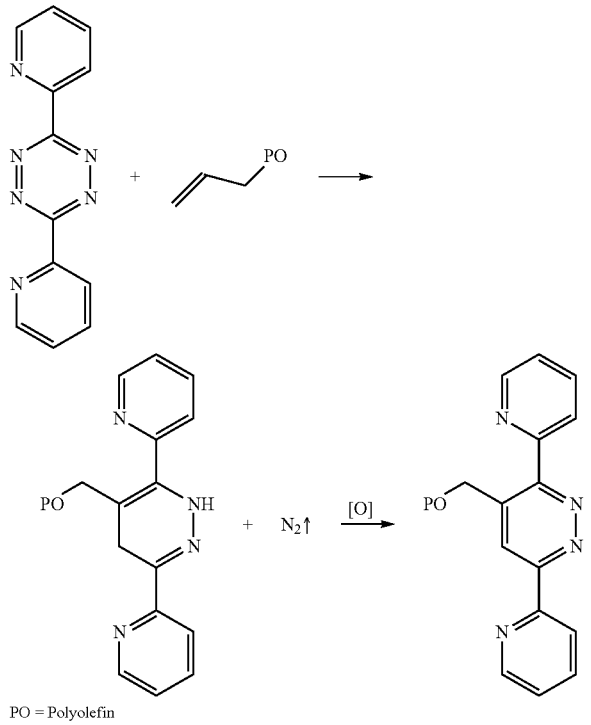

Example 7

Preparation of Lubricant Solutions

PAO 6 (Polyalphaolefin, 6 centirstokes viscosity, ExxonMobil Chemical) was used to make the model oils for our tests. Mobil 1 type fully formulated oil was also used and the ZDDP in the formulation was replaced with aPP-tetrazine to study the its antiwear performance. This also helped to understand its compatibility with many other components present in the oil.

The following six lubricant formulations were used for this study:

a) PAO Base Stock (viscosity grade 6)

b) 0.75% ZDDP 5% Alkylated Naphthalene (AN) in PAO c) 1% aPP-Tetrazine 5% AN in PAO d) 1% aPP-Tetrazine PAO e) 0.75% ZDDP in Fully Formulated Oil with no friction modifier f) 1% aPP-Tetrazine in Fully Formulated Oil with no friction modifier and no ZDDP Example 8

Testing of Lubricant Solutions

Figure 4:
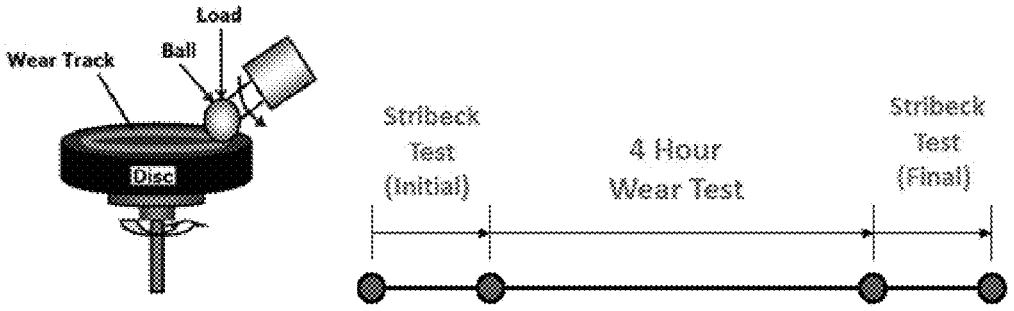
FIG. 4 is a schematic of MTM ball on disc arrangement and test steps.

The above lubricant formulations were then tested using various tribological tests using a Mini Traction Machine (MTM), a Spacer Layer Imaging Method (SLIM), and a High Frequency Reciprocating Rig (HFRR).

i. Standard MTM Tests:

The MTM machine has a ball-on-disc arrangement where the speeds of ball and disc can be controlled independently. This helps to simulate the sliding/rolling contact conditions as commonly found in many machine/engine components such as gears and cams. The standard MTM tests involved initial Stribeck test on fresh surfaces followed by a 4-Hr wear test and a final Stribeck test on the worn surfaces. A schematic of the MTM ball on disc arrangement and the test steps are shown in FIG. 4. The conditions for the Stribeck and wear tests were as follows: Stribeck Tests Conditions: 3000 mm/s-3 mm/s, 50% SRR, 1 GPa, 100° C. Wear Test (4 Hour Tests) with SLIM Measurements: 50 mm/s, 50% SRR, 1 GPa, 100° C.

After finishing each test, the MTM specimens were removed from the apparatus for wear analysis. To remove the residual oils prior to wear measurement, the MTM disc was cleaned using acetone followed by heptane. A Veeco Dektak 150 stylus profilometer was used to generate the 2D and 3D maps of the wear tracks (tribofilms).

Figure 5:
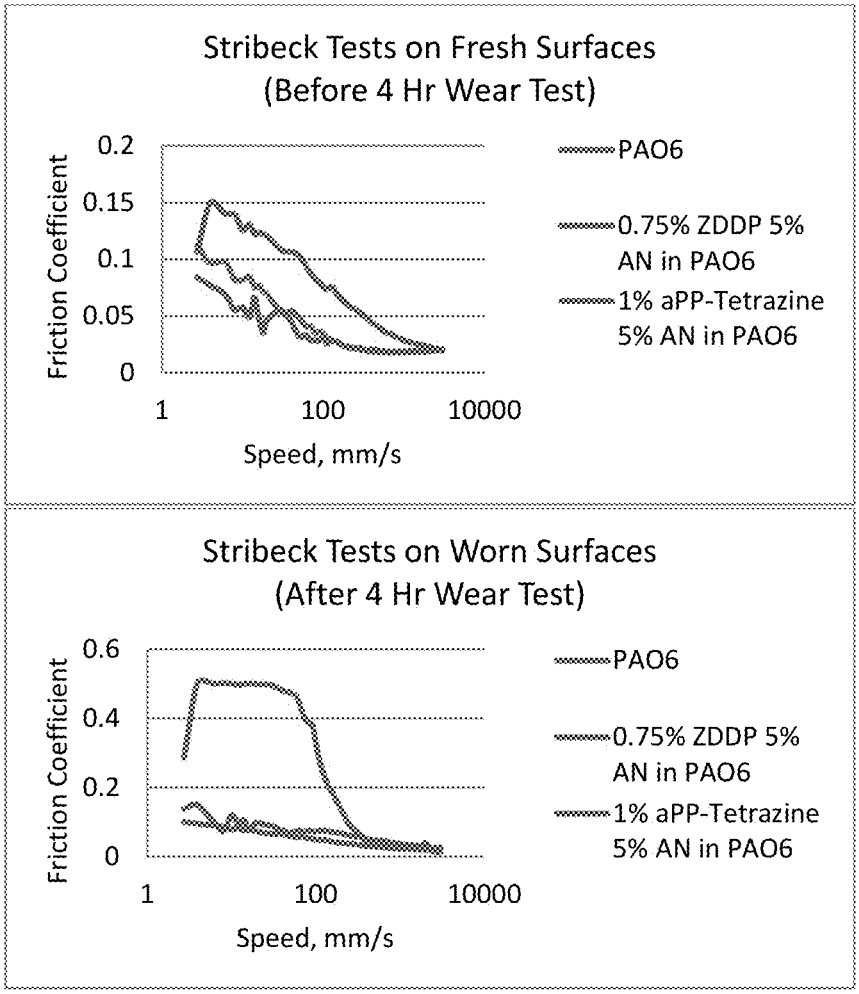
FIG. 5 are graphs of the MTM Stribeck tests before and after the wear tests.
Figure 6:
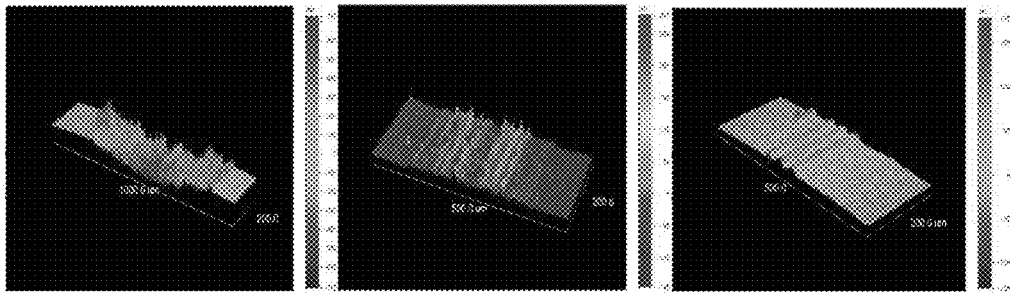
FIG. 6 are 3D wear results from the stylus profilometer measurements for oils: a) PAO Base Stock, b) 0.75% ZDDP 5% Alkylated Naphthalene (AN) in PAO, and c) 1% aPP-Tetrazine 5% AN in PAO.

The stribeck test results are shown in FIG. 5. It is clear from the results that PAO provided relatively low friction under low speed or boundary conditions; however, after four hour wear test, the friction was found to be significantly high in the same speed range. This might be because the surfaces experienced severe adhesive wear during the wear test (FIG. 6). In contrast, both ZDDP and Tetrazine formed patchy tribofilm within the wear track and exhibited similar friction performance both before and after the wear test at low speeds.

In a separate measurement using a Zeta 3D optical image, aPPt deposits were found in the wear track as shown in FIG. 5. It is believed that the multi-colored layers are aPPt deposits or tribofilms. The cross-sectional profile image of aPPt deposits suggests that the deposit or tribofilm thickness appears to be ~100 nm and few microns in width.

Figure 7:
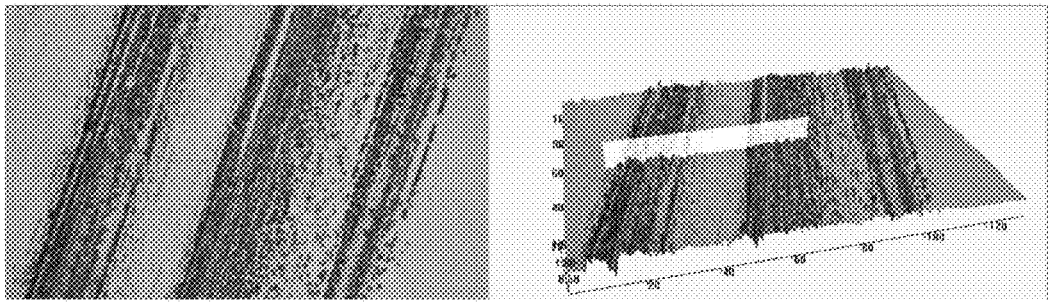
FIG. 7 are surface profiles of aPP-Tetrazine deposits.

FIG. 6 depicts 3D wear results from the stylus profilometer measurements for oils: a) PAO Base Stock, b) 0.75% ZDDP 5% Alkylated Naphthalene (AN) in PAO, and c) 1% aPP-Tetrazine 5% AN in PAO. FIG. 7 depicts surface profiles of aPP-Tetrazine deposits.

ii. MTM-SLIM Tests:

The MTM-SLIM test was run to study the evolution and durability of tribofilm. In this test, the ball was stopped at a given time interval and then the ball was loaded against a glass window to take the wear track image. This was done without removing the ball from the holder in a semi in-situ fashion. After taking each image, the ball was moved back to its original position and loaded against the disc to continue the test. The images were later processed to determine the tribofilm thickness. The MTM-SLIM technique is explained in a greater detail in Study of Zinc Dialkydithiophosphate Antiwear Film Formation and Removal Processes, Part I: Experimental, Tribology Transactions, 48:4, 558 to 566, by Fujita, H., Glovnea, R. P. and Spikes, H. A. (2005), herein incorporated by reference.

Figure 8:
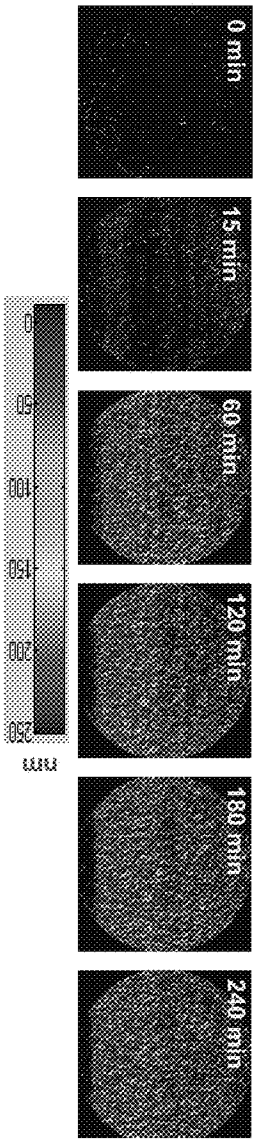
FIG. 8 depicts the evolution of ZDDP tribofilm on smooth ball against smooth disc in a MTM-SLIM test.
Figure 9:
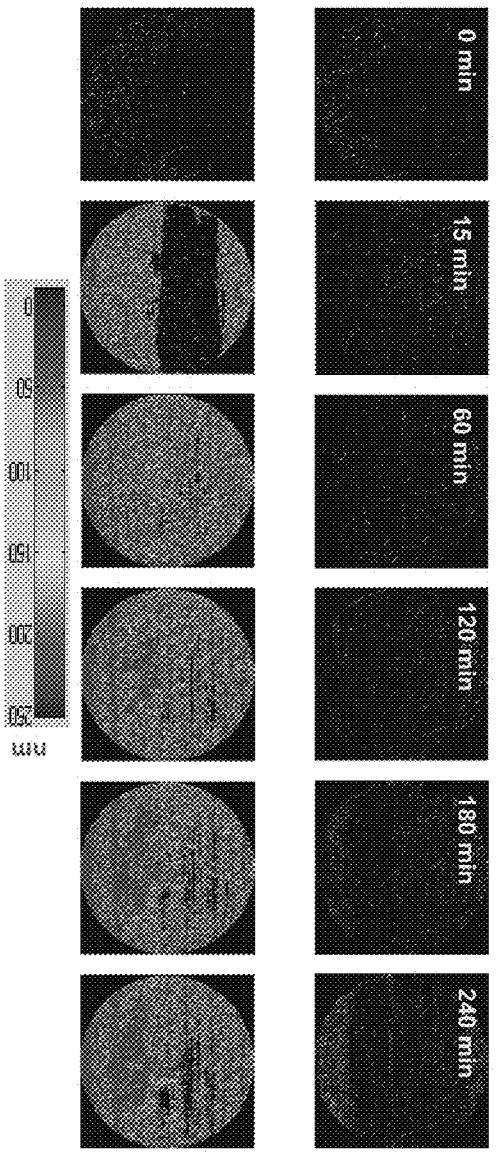
FIG. 9 show the tribofilm durability study results using a smooth ball against a rough disc in the MTM-SLIM system for a) ZDDP and b) aPP-Tetrazine with the images taken on the smooth ball.

The conditions used in the standard MTM tests using smooth ball against smooth discs were favourable for the formation of tribofilms. FIG. 8 shows images collected from such a test where ZDDP forms tribofilm in the first 15 minutes and it remained intact throughout the test. The conditions for this tests were not severe enough to remove the tribofilms from the wear track. Hence, for the tribofilm durability study, the contact severity was increased using a rough disc (Ra=0.15 um) against a smooth ball with the thought that the rough disc would remove the tribofilm generated on the smooth ball. FIG. 9 shows the wear track images in the MTM-SLIM system on a ball running against a rough disc for both a) ZDDP and b) aPP-Tetrazine.

It is apparent from the results that the high contact severity provided by the rough disc did not allow ZDDP to form stable tribofilm. In contrast, aPP-Tetrazine formed a relatively thick and stable tribofilm within first 30 minutes of the test and the tribofim remained intact throughout the test. This establishes the fact that tetrazine outperformed ZDDP in the extreme rolling/sliding type of contact.

iii. HFRR Tests

Figure 10:
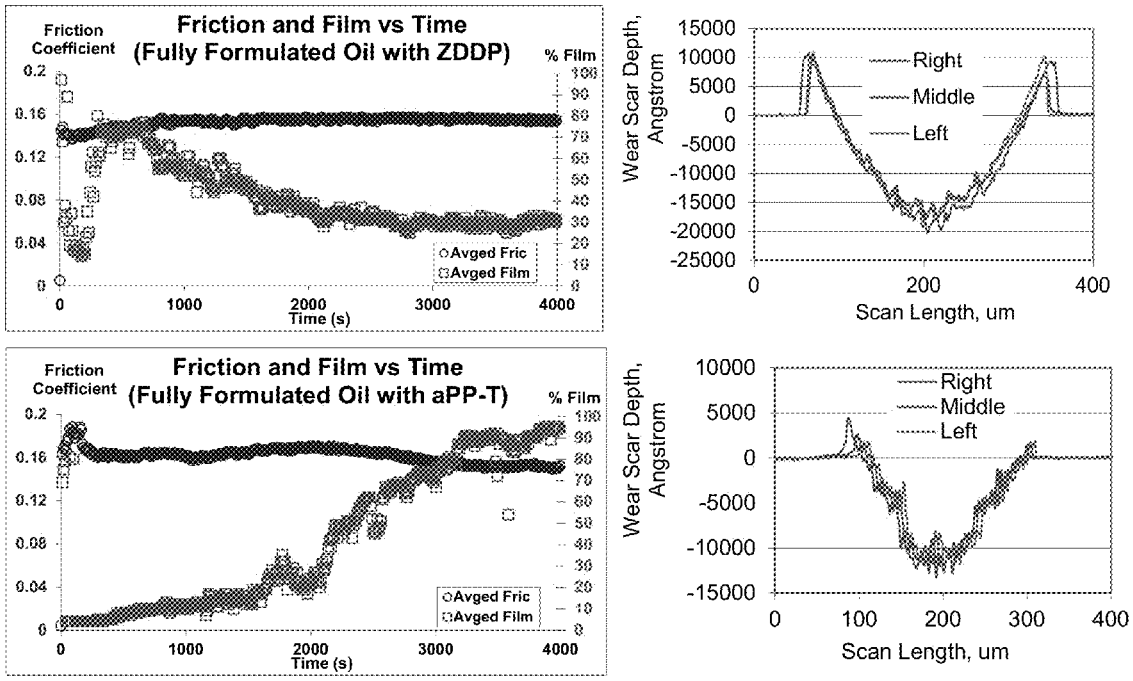
FIG. 10 shows the HFRR Tests for Friction and % Film results (left) and wear scar profiles (right) for ZDDP and aPP-Tetrazine.

To understand the wear performance of Tetrazine under pure sliding contact (engine piston/cylinder is an example of such contact). HFRR tests were performed under extreme boundary conditions. The friction coefficient and % film results for ZDDP and aPP-Tetrazine are shown in FIG. 10. The % film is a qualitative measurement and is an indication of tribofilm coverage within the wear track. After each test, wear on the disc was measured at three locations on the wear track using a stylus profilometer. The profiles of the wear tracks are shown in FIG. 10.

HFRR results reveal that the friction coefficients for ZDDP and aPP-Tetrazine were almost in the same range; however, the % film for ZDDP was significantly lower than aPP-Tetrazine. This correlates with the high wear provided by ZDDP (~2 um max depth) compared to aPP-Tetrazine (~1 um).

It is evident that aPP-Tetrazine forms wear resistant tribofilm within the wear track under both rolling/sliding and pure sliding conditions. More importantly, aPP-Tetrazine provides improved wear protection under extreme boundary conditions where ZDDP failed to perform.

All documents described herein are incorporated by reference herein, including any priority documents and/or testing procedures to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. Likewise, the term "comprising" is considered synonymous with the term "including" for purposes of Australian law.

What is claimed is:

1. A lubricant composition comprising one or more lubricant base oils and an effective amount of at least one zero SAP antiwear and/or corrosion inhibitor additive comprising a functionalized polyolefin including one or more pyridazine moieties according to the following formulae:

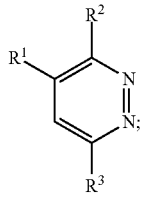

wherein $R^1$ comprises a polyolefin chain attached to the pyridazine moiety through an aliphatic linkage; and wherein $R^2$ and $R^3$ each comprise H;

wherein the functionalized polyolefin number average molecular weight ranges from 200 to 10,000.

2. The lubricant composition of claim 1, wherein the pyridazine moiety is a terminal moiety of the polyolefin chain.

3. The lubricant composition of claim 1, wherein $R^1$ comprises a $C_{2-20}$ poly-alpha-olefin having a weight average molecular weight of greater than or equal to about 2,500 g/mol.

4. The lubricant composition of claim 1, wherein $R^1$ is derived from polyethylene, polypropylene, polybutadiene, butyl rubber, or a combination thereof.

5. The lubricant composition of claim 1, wherein $R^1$ is derived from one or more of:

(i) a vinyl terminated polymer having at least 5% allyl chain ends;

(ii) a vinyl terminated polymer having an Mn of at least 200 g/mol (measured by $^1$H NMR) comprising of one or more $C_4$ to $C_{40}$ higher olefin derived units, where the higher olefin polymer comprises substantially no propylene derived units; and wherein the higher olefin polymer has at least 5% allyl chain ends;

(iii) a copolymer having an Mn of 300 g/mol or more (measured by $^1$H NMR) comprising (a) from about 20 mol % to about 99.9 mol % of at least one $C_5$ to $C_{40}$ higher olefin, and (b) from about 0.1 mol % to about 80 mol % of propylene, wherein the higher olefin copolymer has at least 40% allyl chain ends;

(iv) a copolymer having an Mn of 300 g/mol or more (measured by $^1$H NMR), and comprises (a) from about 80 mol % to about 99.9 mol % of at least one $C_4$ olefin, (b) from about 0.1 mol % to about 20 mol % of propylene; and wherein the vinyl terminated macromonomer has at least 40% allyl chain ends relative to total unsaturation;

(v) a co-oligomer having an Mn of 300 g/mol to 30,000 g/mol (measured by $^1$H NMR) comprising 10 mol % to 90 mol % propylene and 10 mol % to 90 mol % of ethylene, wherein the oligomer has at least X % allyl chain ends (relative to total unsaturations), where: 1) X=(−0.94*(mol % ethylene incorporated)+100), when 10 mol % to 60 mol % ethylene is present in the co-oligomer, 2) X=45, when greater than 60 mol % and less than 70 mol % ethylene is present in the co-oligomer, and 3) X=(1.83* (mol % ethylene incorporated) −83), when 70 mol % to 90 mol % ethylene is present in the co-oligomer;

(vi) a propylene oligomer, comprising more than 90 mol % propylene and less than 10 mol % ethylene wherein the oligomer has: at least 93% allyl chain ends, a number average molecular weight (Mn) of about 500 g/mol to about 20,000 g/mol, an isobutyl chain end to allylic vinyl group ratio of 0.8:1 to 1.35:1.0, and less than 100 ppm aluminum;

(vii) a propylene oligomer, comprising: at least 50 mol % propylene and from 10 mol % to 50 mol % ethylene, wherein the oligomer has: at least 90% allyl chain ends, an Mn of about 150 g/mol to about 10,000 g/mol, and an isobutyl chain end to allylic vinyl group ratio of 0.8:1 to 1.2:1.0, wherein monomers having four or more carbon atoms are present at from 0 mol % to 3 mol %;

(viii) a propylene oligomer, comprising: at least 50 mol % propylene, from 0.1 mol % to 45 mol % ethylene, and from 0.1 mol % to 5 mol % $C_4$ to $C_{12}$ olefin, wherein the oligomer has: at least 90% allyl chain ends, an Mn of about 150 g/mol to about 10,000 g/mol, and an isobutyl chain end to allylic vinyl group ratio of 0.8:1 to 1.35:1.0;

(ix) a propylene oligomer, comprising: at least 50 mol % propylene, from 0.1 mol % to 45 mol % ethylene, and from 0.1 mol % to 5 mol % diene, wherein the oligomer has: at least 90% allyl chain ends, an Mn of about 150 g/mol to about 10,000 g/mol, and an isobutyl chain end to allylic vinyl group ratio of 0.7:1 to 1.35:1.0; and (x) a homo-oligomer, comprising propylene, wherein the oligomer has: at least 93% allyl chain ends, an Mn of about 500 g/mol to about 20,000 g/mol, an isobutyl chain end to allylic vinyl group ratio of 0.8:1 to 1.2:1.0, and less than 1400 ppm aluminum.

6. The lubricant composition of claim 1, wherein the one or more lubricant base oils range from 50 to 99 wt % of the composition.

7. The lubricant composition of claim 1, wherein the effective amount of at least one zero SAP antiwear and/or corrosion inhibitor additive ranges from 10 ppm to 10 wt. % of the composition.

8. The lubricant composition of claim 1, wherein the one or more lubricant base oils are selected from the group consisting of API Group I, Group II, Group III, Group IV, Group V base stocks and combinations thereof.

9. The lubricant composition of claim 1, further including one or more additives selected from the group consisting of oxidation inhibitors, metallic and non-metallic dispersants, metallic and non-metallic detergents, metal deactivators, anti-seizure agents, pour point depressants, wax modifiers, viscosity modifiers, seal compatibility agents, lubricity agents, anti-staining agents, chromophoric agents, defoamants, demulsifiers, and combinations thereof.

10. The lubricant composition of claim 9, wherein the one or more additives range from 1 to 20 wt % of the composition.

11. The lubricant composition of claim 1, wherein the functionalized polyolefin is amorphous.

12. The lubricant composition of claim 1, further including from 0.5 to 10 wt % graphite, graphene or combinations thereof.

13. A lubricant composition comprising one or more lubricant base oils and an effective amount of at least one zero SAP antiwear and/or corrosion inhibitor additive comprising a functionalized polyolefin including one or more pyridazine moieties according to the following formulae:

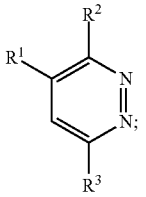

wherein $R^1$ comprises a polyolefin chain attached to the pyridazine moiety through an aliphatic linkage, and wherein $R^2$ and $R^3$ each comprise H, wherein the pyridazine moiety is the cyclo-addition reaction product of a non-aromatic carbon-carbon double bond attached to a backbone of the polyolefin chain through an aliphatic linkage, and a substituted or unsubstituted tetrazine;

wherein $R^1$ comprises a $C_{2-20}$ poly-alpha-olefin having a weight average molecular weight of greater than or equal to about 2,500 g/mol.

14. The lubricant composition of claim 13, wherein the non-aromatic carbon-carbon double bond is a terminal vinyl functional group.

15. The lubricant composition of claim 13, wherein $R^1$ is derived from polyethylene, polypropylene, polybutadiene, butyl rubber, or a combination thereof having a weight average molecular weight of greater than or equal to about 2500 g/mol.

16. The lubricant composition of claim 13, wherein $R^1$ is derived from one or more of:

(i) a vinyl terminated polymer having at least 5% allyl chain ends;

(ii) a vinyl terminated polymer having an Mn of at least 200 g/mol (measured by $^1$H NMR) comprising of one or more $C_4$ to $C_{40}$ higher olefin derived units, where the higher olefin polymer comprises substantially no propylene derived units; and wherein the higher olefin polymer has at least 5% allyl chain ends;

(iii) a copolymer having an Mn of 300 g/mol or more (measured by $^1$H NMR) comprising (a) from about 20 mol % to about 99.9 mol % of at least one $C_5$ to $C_{40}$ higher olefin, and (b) from about 0.1 mol % to about 80 mol % of propylene, wherein the higher olefin copolymer has at least 40% allyl chain ends;

(iv) a copolymer having an Mn of 300 g/mol or more (measured by $^1$H NMR), and comprises (a) from about 80 mol % to about 99.9 mol % of at least one $C_4$ olefin, (b) from about 0.1 mol % to about 20 mol % of propylene; and wherein the vinyl terminated macromonomer has at least 40% allyl chain ends relative to total unsaturation;

(v) a co-oligomer having an Mn of 300 g/mol to 30,000 g/mol (measured by $^1$H NMR) comprising 10 mol % to 90 mol % propylene and 10 mol % to 90 mol % of ethylene, wherein the oligomer has at least X % allyl chain ends (relative to total unsaturations), where: 1) X=(−0.94*(mol % ethylene incorporated)+100), when 10 mol % to 60 mol % ethylene is present in the co-oligomer, 2) X =45, when greater than 60 mol % and less than 70 mol % ethylene is present in the co-oligomer, and 3) X=(1.83* (mol % ethylene incorporated) −83), when 70 mol % to 90 mol % ethylene is present in the co-oligomer;

(vi) a propylene oligomer, comprising more than 90 mol % propylene and less than 10 mol % ethylene wherein the oligomer has: at least 93% allyl chain ends, a number average molecular weight (Mn) of about 500 g/mol to about 20,000 g/mol, an isobutyl chain end to allylic vinyl group ratio of 0.8:1 to 1.35:1.0, and less than 100 ppm aluminum;

(vii) a propylene oligomer, comprising: at least 50 mol % propylene and from 10 mol % to 50 mol % ethylene, wherein the oligomer has: at least 90% allyl chain ends, an Mn of about 150 g/mol to about 10,000 g/mol, and an isobutyl chain end to allylic vinyl group ratio of 0.8:1 to 1.2:1.0, wherein monomers having four or more carbon atoms are present at from 0 mol % to 3 mol %;

(viii) a propylene oligomer, comprising: at least 50 mol % propylene, from 0.1 mol % to 45 mol % ethylene, and from 0.1 mol % to 5 mol % $C_4$ to $C_{12}$ olefin, wherein the oligomer has: at least 90% allyl chain ends, an Mn of about 150 g/mol to about 10,000 g/mol , and an isobutyl chain end to allylic vinyl group ratio of 0.8:1 to 1.35:1.0;

(ix) a propylene oligomer, comprising: at least 50 mol % propylene, from 0.1 mol % to 45 mol % ethylene, and from 0.1 mol % to 5 mol % diene, wherein the oligomer has: at least 90% allyl chain ends, an Mn of about 150 g/mol to about 10,000 g/mol, and an isobutyl chain end to allylic vinyl group ratio of 0.7:1 to 1.35:1.0; and (x) a homo-oligomer, comprising propylene, wherein the oligomer has: at least 93% allyl chain ends, an Mn of about 500 g/mol to about 20,000 g/mol, an isobutyl chain end to allylic vinyl group ratio of 0.8:1 to 1.2:1.0, and less than 1400 ppm aluminum.

17. The lubricant composition of claim 13, wherein the one or more lubricant base oils range from 50 to 99 wt % of the composition.

18. The lubricant composition of claim 13, wherein the effective amount of at least one zero SAP antiwear and/or corrosion inhibitor additive ranges from 10 ppm to 10 wt % of the composition.

19. The lubricant composition of claim 13, wherein the one or more lubricant base oils are selected from the group consisting of API Group I, Group II, Group III, Group IV, Group V base stocks and combinations thereof.

20. The lubricant composition of claim 13, further including one or more additives selected from the group consisting of oxidation inhibitors, metallic and non-metallic dispersants, metallic and non-metallic detergents, metal deactivators, anti-seizure agents, pour point depressants, wax modifiers, viscosity modifiers, seal compatibility agents, lubricity agents, anti-staining agents, chromophoric agents, defoamants, demulsifiers, and combinations thereof.

21. The lubricant composition of claim 20, wherein the one or more additives range from 1 to 20 wt % of the composition.

22. The lubricant composition of claim 13, wherein the functionalized polyolefin number average molecular weight ranges from 200 to 10,000.

23. The lubricant composition of claim 13, wherein the functionalized polyolefin is amorphous.

24. The lubricant composition of claim 13, further including from 0.5 to 10 wt % graphite, graphene or combinations thereof.

* * * * *